US011619475B2

(12) United States Patent
Carr et al.

(10) Patent No.: US 11,619,475 B2
(45) Date of Patent: Apr. 4, 2023

(54) FUZE ARMING TECHNIQUES FOR A SUBMUNITION

(71) Applicant: BAE SYSTEMS plc, London (GB)

(72) Inventors: Andrew Carr, Portsmouth (GB); Murray Thomson, Portsmouth (GB); Timothy Keith Girling, Portsmouth (GB); Martyn John Hucker, Monmouthshire (GB)

(73) Assignee: BAE SYSTEMS plc, London (GB)

( * ) Notice: Subject to any disclaimer, the term of this patent is extended or adjusted under 35 U.S.C. 154(b) by 15 days.

(21) Appl. No.: 17/413,141

(22) PCT Filed: Dec. 17, 2019

(86) PCT No.: PCT/GB2019/053579
§ 371 (c)(1),
(2) Date: Jun. 11, 2021

(87) PCT Pub. No.: WO2020/128451
PCT Pub. Date: Jun. 25, 2020

(65) Prior Publication Data

US 2022/0065604 A1 Mar. 3, 2022

(30) Foreign Application Priority Data

Dec. 19, 2018 (EP) ..... 18275186
Dec. 19, 2018 (GB) ..... 1820705
(Continued)

(51) Int. Cl.
*F42C 15/40* (2006.01)
*F42C 11/00* (2006.01)
(Continued)

(52) U.S. Cl.
CPC ..... *F42C 11/005* (2013.01); *F42B 12/204* (2013.01); *F42B 12/62* (2013.01);
(Continued)

(58) Field of Classification Search
CPC ..... F41B 12/625; F42C 11/00; F42C 15/24; F42C 15/40; F42C 15/15
See application file for complete search history.

(56) References Cited

U.S. PATENT DOCUMENTS 2,060,198 A 11/1936 Hammond, Jr.
2,489,255 A 11/1949 Barker
(Continued)

FOREIGN PATENT DOCUMENTS

DE 321456 C 5/1920
DE 3442456 A1 9/1986
(Continued)

OTHER PUBLICATIONS

International Search Report and Written Opinion received for PCT Application No. PCT/GB2019/053579. dated Apr. 2, 2020. 10 pages.
(Continued)

*Primary Examiner* — Derrick R Morgan
(74) *Attorney, Agent, or Firm* — Finch & Maloney PLLC

(57) ABSTRACT

According to an aspect of the invention, there is provided a fuze arming system for a submunition, comprising: a first stage, arranged to detect launch of the submunition and its associated carrier; a second stage, arranged to detect expulsion of the submunition from the carrier, and to at least partially arm a submunition fuze based on such detection; wherein the second stage is unable to at least partially arm the submunition fuze without the first stage detecting launch of the submunition and its associated carrier.

19 Claims, 17 Drawing Sheets

(30) Foreign Application Priority Data

| | | |
|---|---|---|
| Sep. 4, 2019 | (GB) | 1912696 |
| Dec. 5, 2019 | (EP) | 19275140 |
| Dec. 5, 2019 | (EP) | 19275141 |
| Dec. 5, 2019 | (GB) | 1917753 |
| Dec. 5, 2019 | (GB) | 1917754 |

(51) Int. Cl.

| | |
|---|---|
| ***F42B 12/62*** | (2006.01) |
| ***F42C 13/06*** | (2006.01) |
| ***F42C 15/32*** | (2006.01) |
| ***F42B 12/20*** | (2006.01) |
| ***F42B 30/08*** | (2006.01) |
| ***F42B 21/00*** | (2006.01) |
| ***F42C 5/00*** | (2006.01) |
| *F42B 12/36* | (2006.01) |
| *F42C 9/00* | (2006.01) |
| *F42C 13/08* | (2006.01) |

(52) U.S. Cl.

CPC ..... *F42B 21/00* (2013.01); *F42B 30/08* (2013.01); *F42C 5/00* (2013.01); *F42C 13/06* (2013.01); *F42C 15/32* (2013.01); *F42C 15/40* (2013.01); *F42B 12/365* (2013.01); *F42C 9/00* (2013.01); *F42C 13/08* (2013.01)

(56) References Cited

U.S. PATENT DOCUMENTS

| | | | | |
|---|---|---|---|---|
| 2,803,135 | A | 8/1957 | New | |
| 3,017,832 | A | 1/1962 | MacDonald | |
| 3,252,417 | A | 5/1966 | Johnson, Jr. | |
| 3,343,492 | A | 9/1967 | Kritz | |
| 3,651,697 | A | 3/1972 | Ianuzzi | |
| 3,677,184 | A | 7/1972 | Rabinow et al. | |
| 3,738,270 | A | 6/1973 | Hargett et al. | |
| 3,938,438 | A * | 2/1976 | Anderson | F42B 12/58 102/393 |
| 4,064,806 | A | 12/1977 | Apstein et al. | |
| 4,189,999 | A | 2/1980 | Anderson | |
| 4,207,819 | A | 6/1980 | Geren | |
| 4,215,630 | A | 8/1980 | Hagelberg et al. | |
| 4,603,635 | A * | 8/1986 | Boudreau | F42C 15/40 102/209 |
| 4,727,810 | A | 3/1988 | Furst et al. | |
| 4,833,991 | A * | 5/1989 | Furst | F42C 15/40 102/393 |
| 4,977,545 | A | 12/1990 | Teel et al. | |
| 5,078,069 | A | 1/1992 | August et al. | |
| 5,111,748 | A * | 5/1992 | Thurner | F42B 12/62 102/393 |
| 5,214,618 | A * | 5/1993 | Bugiel | F42B 19/00 367/136 |
| 5,245,927 | A * | 9/1993 | Ranes | F42B 15/38 102/374 |
| 5,271,327 | A * | 12/1993 | Filo | F42C 13/08 102/202.5 |
| 5,275,107 | A * | 1/1994 | Weber | F42C 15/24 102/229 |
| 5,456,427 | A | 10/1995 | Greenhalgh | |
| 5,577,431 | A | 11/1996 | Küsters | |
| 5,761,154 | A | 6/1998 | Mueller et al. | |
| 5,929,370 | A | 7/1999 | Brown et al. | |
| 5,955,698 | A | 9/1999 | Harkins et al. | |
| 6,108,270 | A | 8/2000 | DePoy, II | |
| 6,494,140 | B1 * | 12/2002 | Webster | F42B 15/00 102/374 |
| 6,629,498 | B1 * | 10/2003 | Marquis | F42C 15/40 102/276 |
| 9,846,011 | B1 * | 12/2017 | Clark | F41G 7/001 |
| 10,514,240 | B1 | 12/2019 | Despain | |
| 2003/0070571 | A1 * | 4/2003 | Hodge | F42C 15/34 102/221 |
| 2004/0163564 | A1 * | 8/2004 | Sutcliffe | F42C 11/065 102/266 |
| 2009/0078146 | A1 | 3/2009 | Tepera et al. | |
| 2009/0256024 | A1 | 10/2009 | Rastegar et al. | |
| 2012/0012022 | A1 * | 1/2012 | Bormann | G01S 15/86 102/399 |
| 2013/0180423 | A1 * | 7/2013 | Rastegar | F42C 15/40 324/426 |
| 2014/0216290 | A1 | 8/2014 | Yee et al. | |
| 2014/0338555 | A1 | 11/2014 | Thomas et al. | |
| 2015/0128823 | A1 | 5/2015 | Akcasu et al. | |
| 2019/0310356 | A1 | 10/2019 | Moore | |
| 2020/0033106 | A1 * | 1/2020 | Turner | F42C 15/40 |
| 2021/0071621 | A1 * | 3/2021 | Lefcourt | F02K 9/96 |
| 2022/0049943 | A1 | 2/2022 | Carr et al. | |
| 2022/0090893 | A1 | 3/2022 | Carr et al. | |
| 2022/0120546 | A1 | 4/2022 | Carr et al. | |

FOREIGN PATENT DOCUMENTS

| | | | |
|---|---|---|---|
| DE | 3610358 | A1 | 10/1987 |
| DE | 3800407 | C1 | 3/1989 |
| DE | 3937762 | A1 | 5/1991 |
| DE | 19831807 | A1 | 2/1999 |
| DE | 102007048072 | A1 | 4/2009 |
| EP | 0149778 | A2 | 7/1985 |
| EP | 0281088 | A2 | 3/1988 |
| FR | 2640371 | A1 | 6/1990 |
| GB | 2188402 | A | 9/1987 |
| GB | 2277980 | A | 11/1994 |
| WO | 2009046799 | A1 | 4/2009 |
| WO | 2014037934 | A1 | 3/2014 |
| WO | 2020128437 | A2 | 6/2020 |
| WO | 2020128437 | A3 | 6/2020 |
| WO | 2020128451 | A1 | 6/2020 |
| WO | 2020128453 | A1 | 6/2020 |
| WO | 2020128454 | A1 | 6/2020 |

OTHER PUBLICATIONS

Combined Search and Examination Report under Sections 17 and 18(3) received for GB Application No. 1918622.0, dated May 22, 2020. 4 pages.

International Preliminary Report on Patentability received for PCT Application No. PCT/GB2019/053533. dated Jul. 1, 2021. 11 pages.

International Preliminary Report on Patentability received for PCT Application No. PCT/GB2019/053579. dated Jul. 1, 2021. 7 pages.

International Preliminary Report on Patentability received for PCT Application No. PCT/GB2019/053586. dated Jul. 1, 2021. 7 pages.

International Preliminary Report on Patentability received for PCT Application No. PCT/GB2019/053583. dated Jul. 1, 2021. 7 pages.

International Search Report and Written Opinion received for PCT Application No. PCT/GB2019/053586. dated Apr. 6, 2020. 11 pages.

Examination Report under Section 18(3) received for GB Application No. 1918630.3, dated Jun. 10, 2020. 6 pages.

International Search Report and Written Opinion received for PCT Application No. PCT/GB2019/053583. dated Apr. 7, 2020. 11 pages.

Combined Search and Examination Report under Sections 17 and 18(3) received for GB Application No. 1918625.3, dated Jun. 4, 2020. 5 pages.

International Search Report and Written Opinion received for PCT Application No. PCT/GB2019/053533. dated Jun. 24, 2020. 17 pages.

Invitation to Pay Additional Fees and Partial International Search Report received for PCT Application No. PCT/3B2019/053533. dated Mar. 17, 2020. 11 pages.

Partial European Search Report received for EP Application No. 18275186.7, dated Jun. 24, 2019. 14 pages.

Extended European Search Report received for EP Application No. 18275186.7, dated Sep. 26, 2019. 12 pages.

(56) References Cited

OTHER PUBLICATIONS

GB Search Report under Section 17(5) received for GB Application No. 1820705.0, dated Mar. 1, 2019. 4 pages.

* cited by examiner

FUZE ARMING TECHNIQUES FOR A SUBMUNITION

The present invention relates generally to a munition or munition assembly, and in particular to a munition or munition assembly that is adapted to be launched, into the air, from a gun barrel. A related submunition, assembly, method, and reconnaissance projectile assembly and reconnaissance sub-projectile are also provided. Apparatus and methods suitable for use with such munitions and submunitions, and suitable for more general use, are also provided.

For the purposes of this disclosure, aspects, embodiments, and general description and discussion of munitions, in terms of technical details or associated functionality, applies equally to submunitions. In some instances, for certain functionality, the term munition will be understood to cover the term submunition. For example, this is in instances where it is not important if the functionality is linked to the "sub" nature of the submunition, but is instead linked to the explosive nature of the munition in general. In other words, it may not be necessary for the munition to be expelled from a carrier, in order to embody the inventive concept that is being described. This is clear from the disclosure as a whole.

Munitions are provided in a number of different forms, for a number of different applications. Typically, a particular munition will be used for a particular application or intention. A good example of this is when an application involves engaging with or generally interacting with an underwater object (e.g. a target).

When engaging an underwater target, a typical approach is to use a depth charge. The depth charge is dropped off the side of a vessel, or from a helicopter or similar, and the depth charge then descends in the water to a predetermined depth where the depth charge is activated (i.e. detonates). Ideally, this depth will be in the general vicinity of the object or target to be engaged, to damage or disable that target. While engaging a target with one or more depth charges has been relatively commonplace for decades, and is often effective, there are disadvantages. One of the main disadvantages is range. That is, while the depth charge may inflict the required damage on the underwater target, this may be difficult or impossible to achieve if the underwater target is not located immediately below the vessel engaged in that target, but is instead located some distance away from the vessel (e.g. measured across the surface of the water), for example hundreds of metres, or kilometres. Additionally, it may be difficult to engage the target with multiple depth charges simultaneously, or simultaneously from multiple vessels. Also, any explosion caused by the depth charge may, if in the vicinity of the vessel itself, risk damaging the actual vessel that deployed the depth charge.

While the use of helicopters can of course significantly increase the range of the use of depth charge from the vessel deploying the depth charge or helicopter, this then necessarily involves the use of a helicopter, which can be expensive or risky. Of course, it is not practical, and sometimes not possible, to use one or more, or a swarm, of helicopters in order to deploy multiple, or a swarm, of depth charges at any significant distance from the vessel. Also, even though helicopters are fast moving, it may take a significant amount of time for a helicopter to reach a target location, and deploy the depth charge. This is particularly the case when the helicopter is not already in flight, when a command or instruction to engage is issued.

Another approach involves the use of mortar bombs. Mortar bombs may be launched from the deck of a vessel, and into the surrounding water, where the mortar bombs then descend to a particular depth and explode to disable or damage the underwater target. While these mortar bombs perhaps have an increased range in comparison with the use of depth charges, their explosive capability is perhaps not as significant as a depth charge. Also, the firing accuracy is not ideal, and the range of the mortar bomb, is still limited.

A yet further approach to engaging underwater targets is the use of torpedoes, for example deck-launched torpedoes launched from the deck of a vessel, or those launched from a submarine, helicopter or airplane. The use of torpedoes might overcome some of the problems discussed above with regard to range, mainly because torpedoes are self-propelled. However, torpedoes are ultimately too expensive to be used speculatively, or too expensive to use multiple torpedoes at any one time to cause multiple explosions in or around the vicinity of an expected or determined location of the target.

Additionally, even when a munition is fired from a gun, achieving significant range with great accuracy, a natural (e.g. ballistic) trajectory will result in impact with a surface of a body of water that is likely to cause damage to the munition, a significant change of course of the munition, or generally result in the munition not functioning as perhaps initially intended.

It is also known that great care needs to be taken when implementing fuze systems and related methodology in conjunction with submunitions. In particular, care needs to be taken to ensure that the submunition fuze is armed or triggers as intended, and this can be made more difficult given that the submunition is carried by a carrier, and this carrier may be in some way launched prior to subsequent expulsion of the submunition from that carrier. This might mean that there are a number of different, extreme environmental conditions that the fuze system of the submunition needs to take into account or withstand, but at the same time still operating safely and yet triggering a related explosive charge as and when intended.

It is an example aim of example embodiments of the present invention to at least partially avoid or overcome one or more disadvantages of the prior art, whether identified herein or elsewhere, or to at least provide a viable alternative to existing apparatus and methods.

According to a first aspect of the invention, there is provided a fuze arming system for a submunition, comprising: a first stage, arranged to detect launch of the submunition and its associated carrier; a second stage, arranged to detect expulsion of the submunition from the carrier, and to at least partially arm a submunition fuze based on such detection; wherein the second stage is unable to at least partially arm the submunition fuze without the first stage detecting launch of the submunition and its associated carrier.

The first stage may be arranged to control the supply of electrical power to the second stage, conditional on detecting launch of the submunition and its associated carrier.

The first stage may be arranged to supply electrical power to the second stage, conditional on detecting launch of the submunition and its associated carrier.

The supply may be triggered or generated by launch of the submunition and its associated carrier.

The second stage is arranged to electronically detect: separation of the submunition from the carrier, and/or expulsion of the submunition from the carrier, Detection of separation may be based on detecting a property indicative of the presence or absence of the carrier, and/or detection of expulsion may be based on detecting a property indicative of speed or acceleration of the submunition.

The second stage may be unable to electronically detect the separation and/or expulsion without being supplied with electrical power.

The second stage may be arranged to electronically detect the separation, and separately detect the expulsion.

Detection of separation and expulsion may be required to at least partially arm the submunition fuze.

Detection of expulsion before separation may be required to at least partially arm the submunition fuze.

The first stage may be arranged to detect launch of the submunition and its associated carrier based on detecting on a property indicative of a speed or acceleration of the submunition and carrier, and/or detecting a property indicative of a spin rate of the submunition and carrier.

The first stage may be arranged to detect launch of the submunition and its associated carrier based on:

detecting a property indicative of a speed or acceleration of the submunition and carrier, and a property indicative of a spin rate of the submunition and carrier; and detecting the property indicative of speed or acceleration before the property indicative of the spin rate.

According to a second aspect of the invention, there is provided a submunition comprising the fuze arming system of the first aspect.

According to a third aspect of the invention, there is provided a munition assembly, the assembly comprising: a carrier for a submunition, the carrier comprising a cavity in which the submunition is located; and a submunition according to the second aspect, carried by the carrier in the cavity, the submunition arranged to be controllably expelled from the carrier; the submunition comprising: a submunition explosive charge; a submunition fuze, and wherein the munition assembly is adapted to be launched, and where the submunition is then arranged to be controllably expelled from the carrier; and the submunition fuze is adapted to trigger the submunition explosive charge.

The assembly may be adapted to be launched, into the air, from a gun barrel.

The submunition may then be arranged to be controllably expelled from the carrier and enter a body of water; and the submunition fuze is adapted to trigger the submunition explosive charge underwater.

According to a fourth aspect of the invention, there is provided a fuze arming method for a submunition, the method comprising: detecting launch of the submunition and its associated carrier; detecting expulsion of the submunition from the carrier, and at least partially arming a submunition fuze based on such detection; and wherein the submunition fuze is unable to be at least partially armed, without detecting launch of the submunition and its associated carrier.

According to a fifth aspect of the invention, there is provided a fuze arming system for a submunition, comprising: a stage, arranged to detect separation of the submunition from its associated carrier, and to at least partially arm a submunition fuze based on such detection; wherein the stage is arranged to electronically detect the separation.

Detection of separation may be based on detecting a property indicative of the presence or absence of the carrier.

The stage may be unable to electronically detect the separation without being supplied with electrical power.

The stage may be unable to at least partially arm the submunition fuze without being supplied with electrical power.

The stage may be arranged to detect expulsion of the submunition from the carrier, optionally separately from the detection of separation.

Detection of separation and expulsion may be required to at least partially arm the submunition fuze.

Detection of expulsion before separation may be required to at least partially arm the submunition fuze.

The stage may be a second stage of the fuze arming system, and wherein the system further comprises a first stage, arranged to detect launch of the submunition and its associated carrier.

The first stage may be arranged to control the supply of electrical power to the second stage, conditional on detecting launch of the submunition and its associated carrier.

The first stage may be arranged to supply electrical power to the second stage, conditional on detecting launch of the submunition and its associated carrier.

The supply may be triggered or generated by launch of the submunition and its associated carrier.

According to a sixth aspect of the invention, there is provided a submunition comprising the fuze arming system of any preceding claim.

According to a seventh aspect of the invention, there is provided a munition assembly, the assembly comprising: a carrier for a submunition, the carrier comprising a cavity in which the submunition is located; and a submunition according to the sixth aspect, carried by the carrier in the cavity, the submunition arranged to be controllably expelled from the carrier; the submunition comprising: a submunition explosive charge; a submunition fuze, and wherein the munition assembly is adapted to be launched, and where the submunition is then arranged to be controllably expelled from the carrier; and the submunition fuze is adapted to trigger the submunition explosive charge.

The assembly may be adapted to be launched, into the air, from a gun barrel.

The submunition may then be arranged to be controllably expelled from the carrier and enter a body of water; and the submunition fuze is adapted to trigger the submunition explosive charge underwater.

According to an eighth aspect of the invention, there is provided a fuze arming method for a submunition, the method comprising: electronically detecting separation of the submunition from its associated carrier, and at least partially arming a submunition fuze based on such detection.

More generally, any one or more features described in relation to any one aspect may be used in combination with, or in place of, any one or more feature of any one or more other aspects of the invention, unless such replacement or combination would be understood by the skilled person to be mutually exclusive, after a reading of the present disclosure.

For a better understanding of the invention, and to show how embodiments of the same may be carried into effect, reference will now be made, by way of example, to the accompanying diagrammatic Figures in which:

FIG. 1 schematically depicts a vessel launching a munition into the air, from a gun barrel, in accordance with an example embodiment;

FIG. 2 shows the munition of FIG. 1 being directed towards a body of water, in accordance with an example embodiment;

FIG. 3 schematically depicts different approaches to slowing the munition in the air, before entering into the water, in accordance with example embodiments;

FIG. 4 schematically depicts how the fuze may be adapted to initiate the main charge of the munition, under the water, in accordance with a particular criteria, according to example embodiments;

FIG. 5 schematically depicts how the fuze may be adapted to initiate the main charge of the munition, under the water, in accordance with another criteria, according to other example embodiments;

FIG. 6 schematically depicts how the fuze may be adapted to initiate the main charge of the munition, under the water, in accordance with another criteria, according to other example embodiments;

FIG. 7 schematically depicts an artillery shell according to an example embodiment, including a munition according to an example embodiment;

FIG. 8 schematically depicts general methodology associated with the implementation of example embodiments;

FIG. 9 schematically depicts a reconnaissance projectile, in accordance with an example embodiment;

FIG. 10 schematically depicts operating principles associated with the reconnaissance projectile of FIG. 9, according to an example embodiment;

Figure 15:
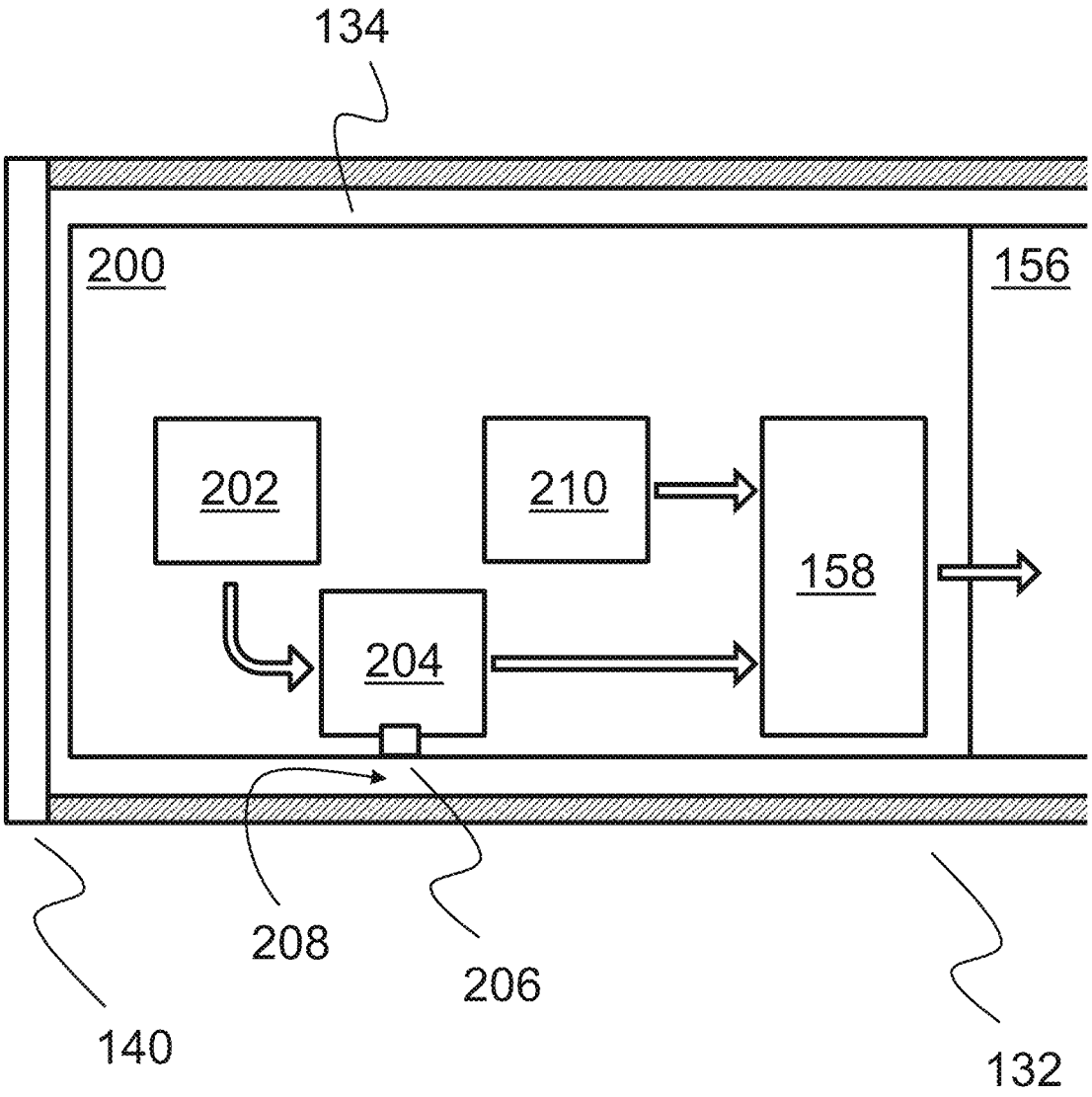
FIG. 15 shows a fuze arming system for a submunition, in accordance with an example embodiment.
Figure 16:
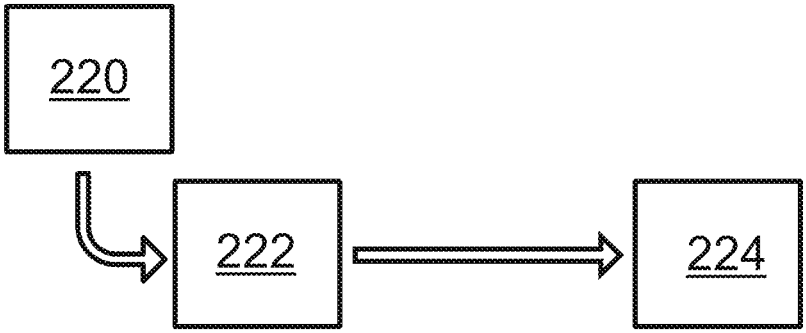
Figure 17:
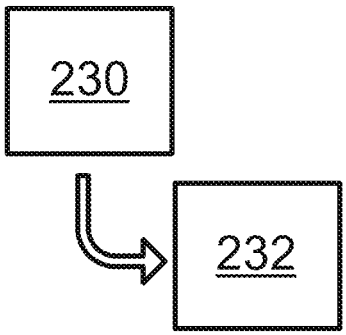

FIG. 16 schematically depicts general fuze arming methodology associated with the system of FIG. 15, in accordance with an example embodiment; and FIG. 17 schematically depicts general fuze arming methodology associated with the system of FIG. 15, in accordance with another example embodiment.

As discussed above, there are numerous disadvantages associated with existing apparatus and methods for engaging underwater targets. These range from the limited range of some existing munitions used for such purposes, to the limited accuracy of existing munitions, or the significant expense associated with existing munitions. In general, there is exists no relatively inexpensive, rapidly deployable, and yet long-range and accurate, munition, or related assembly or methodology, for engaging or generally interacting with underwater objects (e.g. targets).

According to the present disclosure, it has been realised that the problems associated with existing approaches can be overcome in a subtle but effective and powerful manner. In particular, the present disclosure provides a munition. The munition comprises an explosive charge and a fuze. The munition is adapted to be launched, into the air. Significantly, the munition is adapted to be launched from a gun barrel. This means that the munition typically (and practically likely) includes, or is at least used in conjunction with, a propelling explosive, and is capable of being explosively propelled and withstanding such explosive propulsion. This is in contrast with, for example, a depth charge, or torpedo. Being launched from a gun barrel, this is also in contrast with a mortar bomb. The munition is adapted to be launched and then enter a body of water, typically within which body of water a target or object to be engaged would be located. The fuze of the munition is adapted to trigger the explosive charge of the munition under water, for example in accordance with pre-set criteria. The use of a gun barrel also ensures high degree of accuracy in terms of ranging and general targeting.

The disclosure is subtle but powerful. The disclosure is subtle because it perhaps takes advantage of some existing technologies, in the form of firing a munition from a gun barrel. This means that the range of the munition would be hundreds of metres, or even kilometres, overcoming range problems associated with existing apparatus or methodology. At the same time, the munition will typically be a projectile, therefore being unpropelled and/or including no form of self-propulsion. This means that the munition is relatively simple and inexpensive. Altogether then, this means that the munition according to example embodiments can be used to accurately, cheaply, effectively, and generally efficiently engage with targets located at quite some distance from an assembly (e.g. a platform, vessel, vehicle, and so on, or a related gun) that launches the projectile. Also, the use of a munition that is capable of being launched from a gun barrel means that multiple munitions can be launched very quickly in succession from the same gun barrel, or in succession and/or in parallel from multiple gun barrels, optionally from different assemblies, or optionally being targeted onto or into the same location/vicinity of the same body of water. Again then, target engagement efficiency and effectiveness may be increased, in a relatively simple manner.

Figure 1:
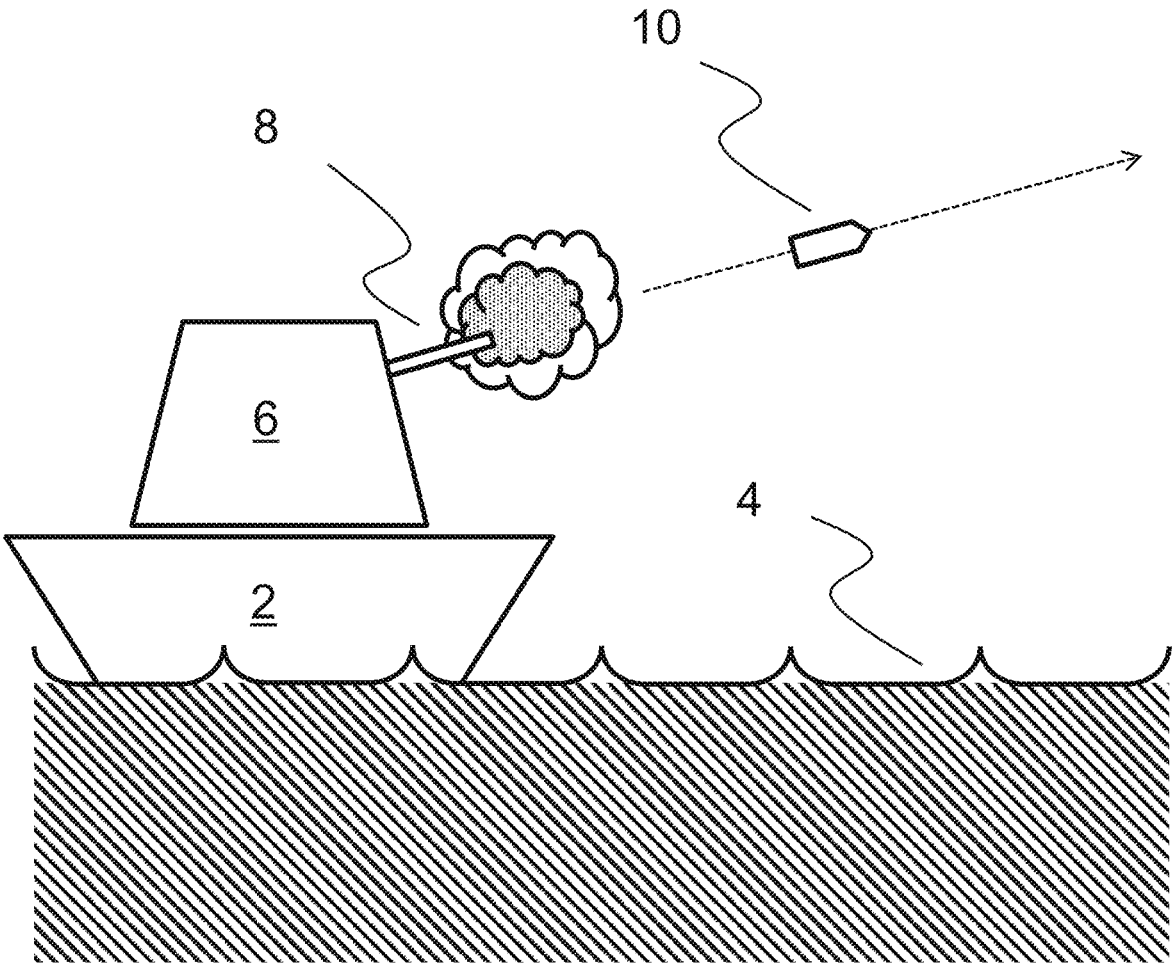

FIG. 1 schematically depicts an assembly in accordance with an example embodiment. In this example, the assembly comprises a vessel 2 located on a body of water 4. The vessel comprises a gun 6 having a gun barrel 8. In another example, the assembly need not include a particular vehicle, and could simply comprise a gun.

The munition 10 is shown as being explosively launched into the air. As discussed above, this gives the munition 10 significant range, and accuracy at range.

Prior to being launched into the air, the munition 10 (or more specifically its fuze) might be programmed in some way. The programming might take place within the gun 6, within the barrel 8, or even within a particular range after launch of the munition 10, for example by a wireless transmission or similar. The programming might be undertaken to implement or change particular fuze criteria, for example to trigger explosive within the munition 10 in accordance with particular criteria. This will be explained in more detail below. Typically, in order to achieve this programming, the munition 10 will comprise a programmable fuze. That is, the fuze is able to be configured.

As is typical for munitions fired from a gun barrel, the munition will typically be arranged to be launched from a smooth bore gun barrel. Optionally, the munition may be fin-stabilised. Alternatively, the munition may be arranged to be launched from a rifled bore. The exact configuration will be dependent on the required application.

As discussed throughout, care will need to be undertaken to ensure that the combination of munition properties (e.g. size, weight, shape and so on) and launch specifications (e.g. explosive propulsion) is such that the munition 10 does not explode on launch. This might require particular care to be given to the explosive resistance of the munition 10, or at least constituent parts located within the munition, typically associated with initiating an explosion of the munition 10. Such concepts will be known or derivable from munitions technologies typically involved in gun-based launching.

Figure 2:
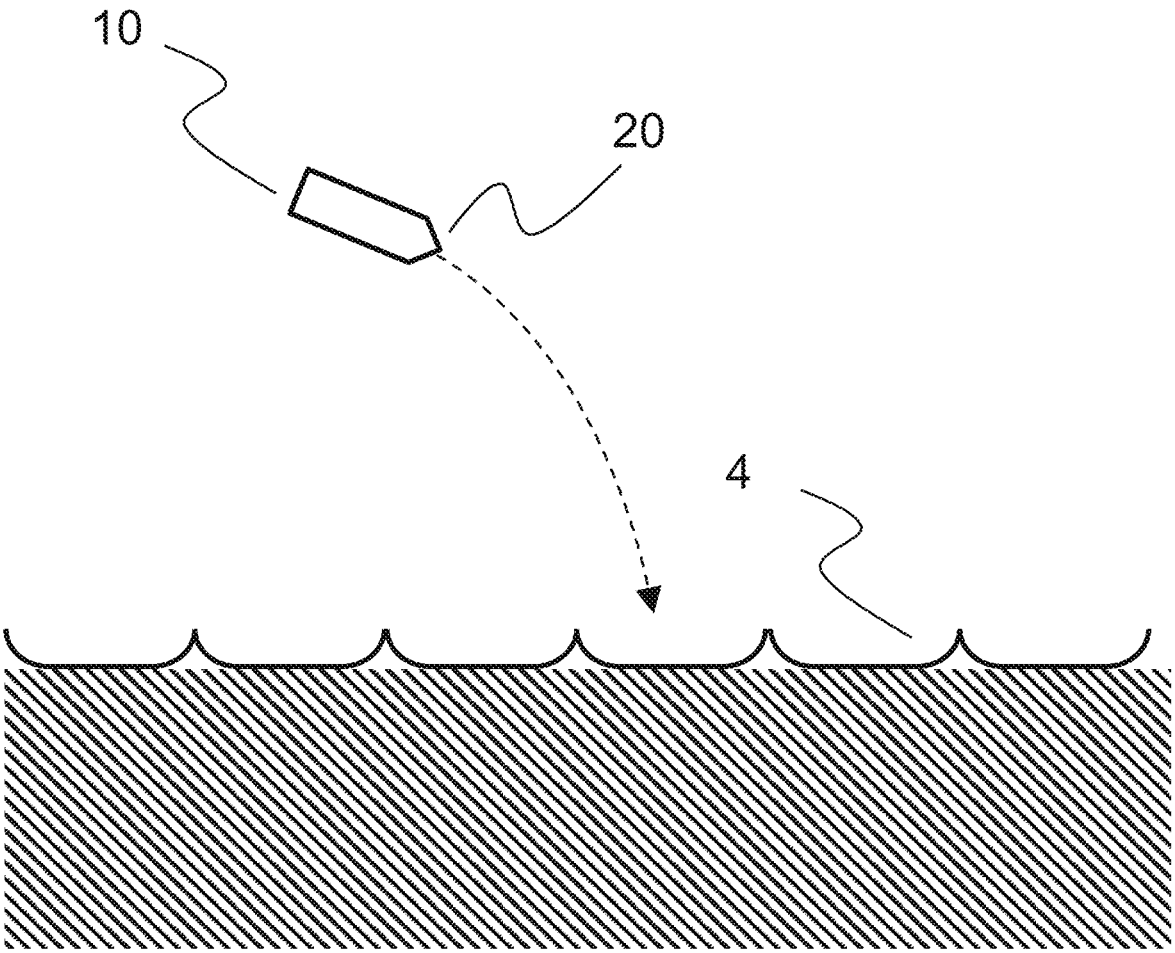

FIG. 2 shows the munition as it is directed to and is about to enter the body of water 4. Having been explosively launched from a gun barrel 8, the munition 10 will enter the body of water 4 with significant speed. In a practical implementation, care will need to be undertaken to ensure that the combination of munition properties (e.g. size, weight, shape and so on) and impact speed with the water 4 is such that the munition 10 does not explode on impact. This might require particular care to be given to the impact resistance of the munition 10, or at least constituent parts located within the munition, typically associated with initiating an explosion of the munition 10.

In one example, a simple but effective feature which may assist in this regard is the head or tip 20 of the munition being ogive-shaped or roundly-shaped or tapering, in accordance with the typical shape of munitions. Again, this is in contrast with a depth charge or similar. However, this may not be sufficient in isolation, or even in combination with structural impact-resistant features of a munition, to prevent explosion of the munition 10 on impact with the water, or to damage the munition such that it does not work satisfactorily under the water 4.

Figure 3:
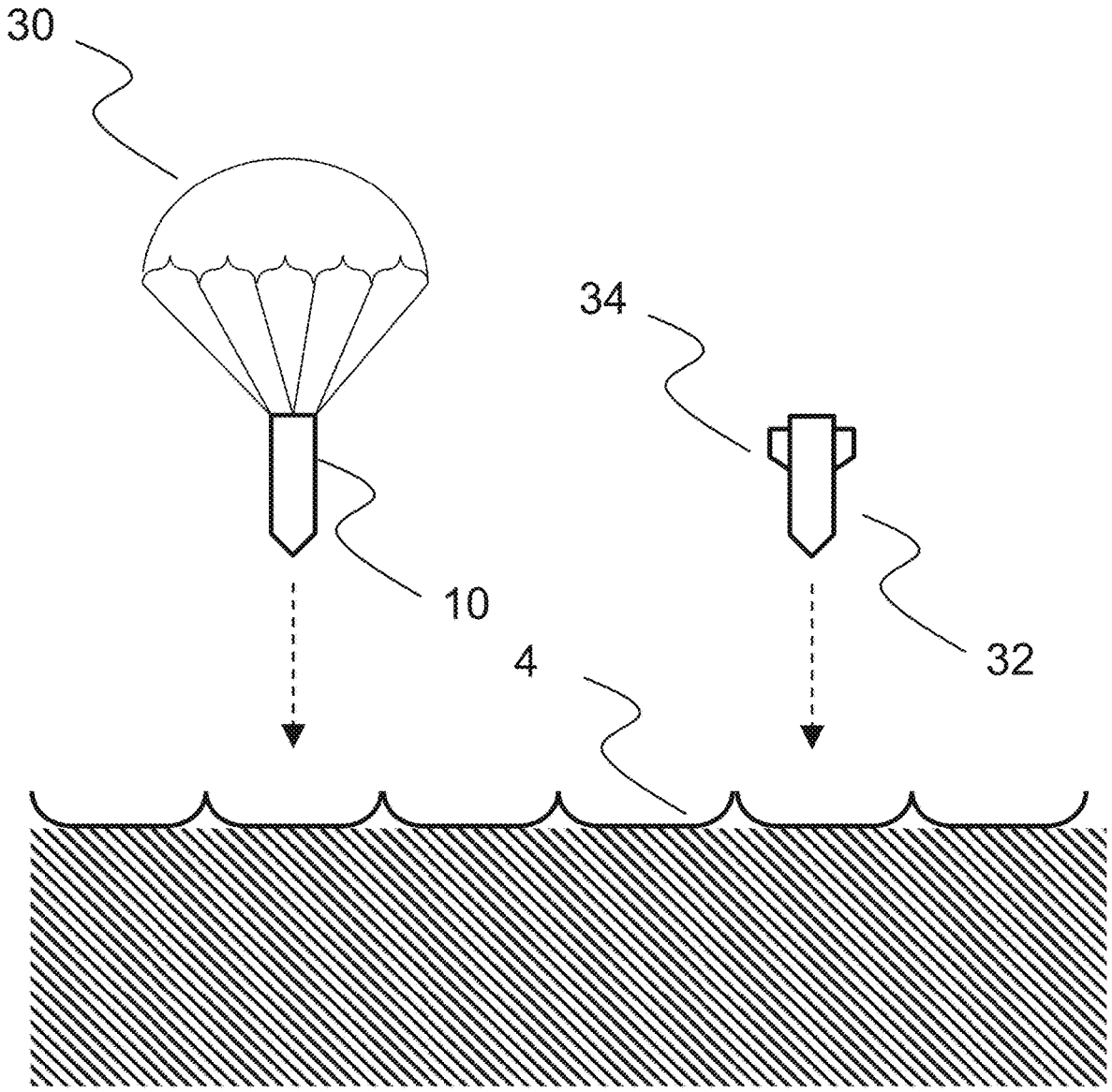

FIG. 3 shows that in addition to, or alternatively to, an impact resistant or accommodating structure of the munition 10, the munition 10 may be provided with a deployable configuration that is arranged, when deployed, to slow the munition 10 in the air before entry into the water 4. In order to successfully engage with an underwater target described herein, the speed of decent of the munition down, through the water 4 to the target may be less important than the speed of delivery of the munition from the gun to the location at/above the target. In other words, the munition 10 does not need to enter the water 4 at a particularly high velocity. Therefore, deceleration of the munition 10 prior to entering the water 4 is acceptable, and may actually be desirable. That is, slowing the munition 10 prior to entering the water 4 may be far simpler or easier to achieve than designing the munition to withstand high speed impact with the water 4. This is because such a design might mean that the cost of the munition is excessive, or that the weight of the munition is excessive, or such that the space within the munition for important explosive material is reduced. In other words, some form of air brake might be advantageous.

FIG. 3 shows that, in one example, the deployable configuration could comprise a parachute 30. The parachute could be deployed after a certain time from launch of the munition 10, or could, with appropriate sensing or similar, be deployed upon particular distance proximity sensing with respect to the water 4.

In another example, a similar munition 32 is shown. However, this similar munition 32 comprises a different deployable configuration in the form of one or more deployable wings or fins 34. These deployable wings or fins 34 may be deployed in the same manner as the parachute 30 previously described. The wings or fins 34 might optionally provide a degree of auto rotation to slow or further slow the munition 32. As discussed above, it is desirable for the munition to reach the location of the target object, or its surrounding area quickly and effectively, while at the same time being relatively inexpensive and having maximum effectiveness. It is therefore desirable not to pack the munition with complicated or advanced guiding or directionality mechanisms, which might be used to control the directionality of the descent of the munition. However, in some examples the fins and/or wings 34 previously described may be controllable to provide directional control of the descent of the munition 32, for example via a movable control surface provided in or by the fins or wings. Such control is typically not to be used during projectile-like flight of the munition 32, for example immediately after launch, but instead might be used for a degree of tuning control of the descent of the projectile into the body of water. This might improve engagement accuracy and effectiveness with a target located in the body of water 4. However, as alluded to above, in other examples the munition according to example embodiments may be free of such directional (descent) control, to ensure that the cost and complexity of the munition is minimised, and such that any related cost or space budget is taken up with more core aspects, such as volume of explosive.

After entering the body of water, the munition may be arranged to retract or dispose of the deployable configuration, so that the deployable configuration does not slow (or slow to too great an extent) the descent of the munition toward the target. For similar reasons, the munition might be free of any such deployable configuration, such that there is no impact on descent in the water. Descent through the water may need to be as fast as possible (e.g. to avoid the object moving to avoid the munition).

Figure 4:
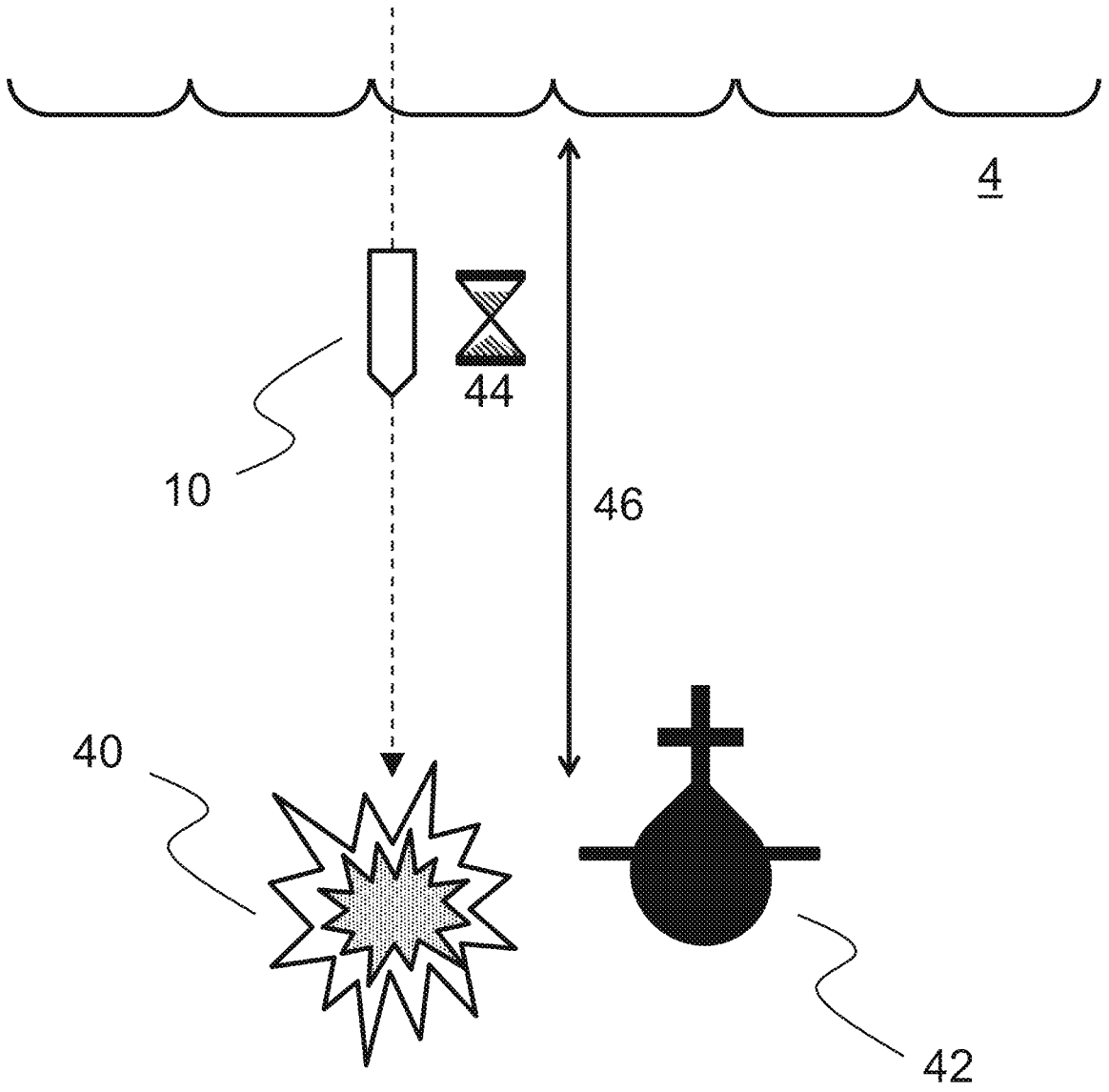
Figure 5:
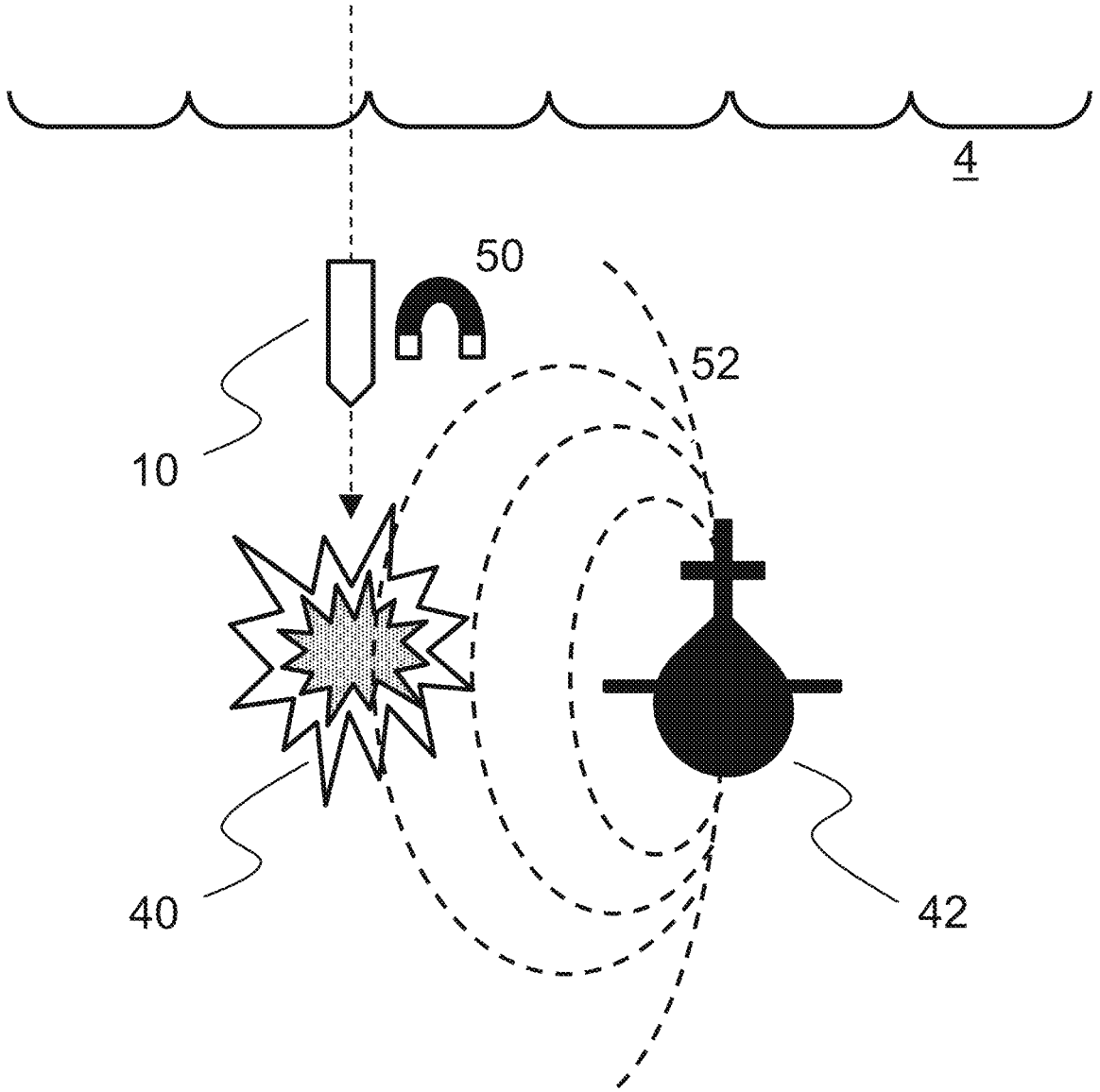
Figure 6:
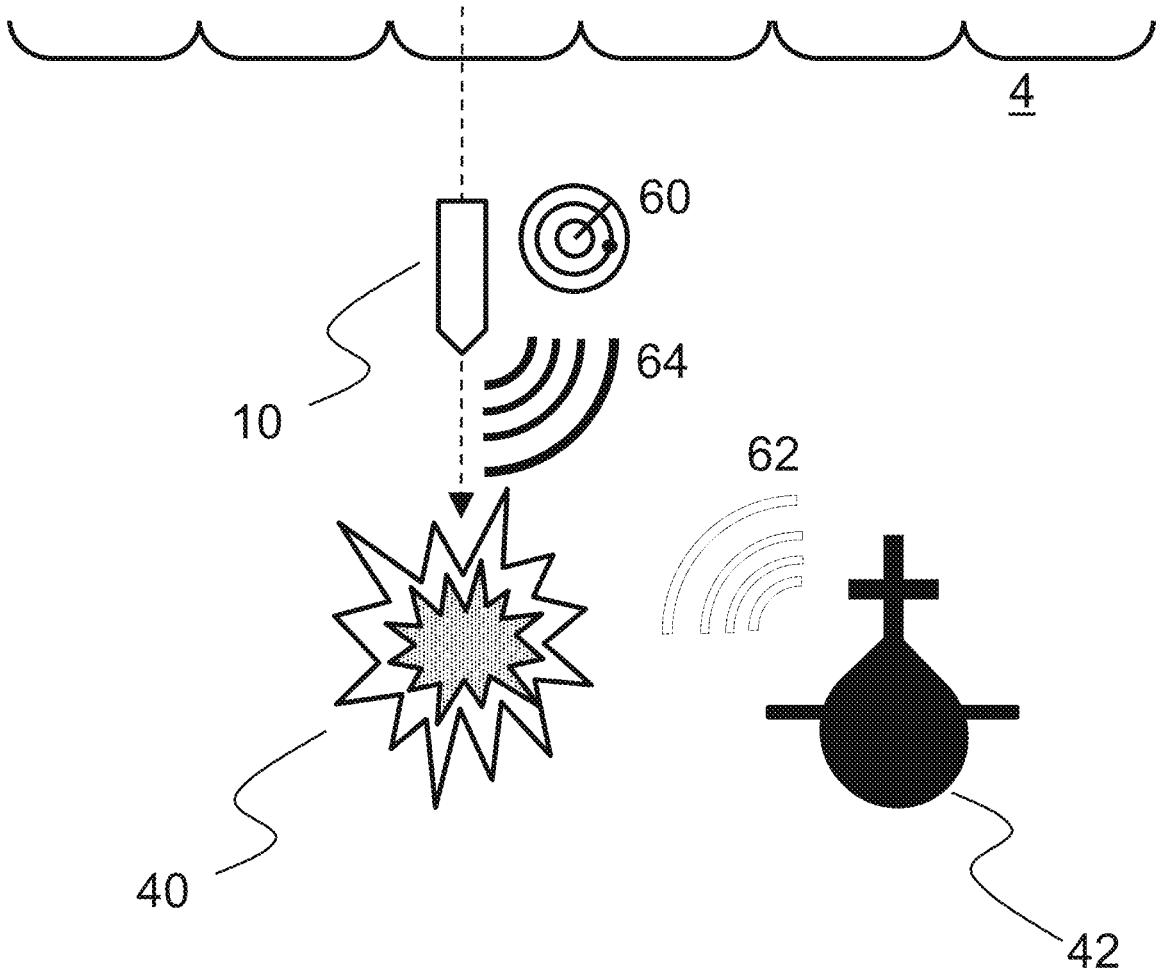

After entering the body of water, the munition will descend within the body of water. The fuze within the munition is adapted to trigger the explosive charge within the munition in the water (that is under the water surface). This triggering can be achieved in one of a number of different ways. FIGS. 4 to 6 give typical examples.

FIG. 4 shows that the fuze may be adapted to trigger 40 explosive within the munition 10 in order to successfully and effectively engage an underwater target 42. This might be achieved by triggering the explosive charge after a particular time 44, for example from one or more of a combination of launch from the gun barrel described above, and/or a predetermined time period after entering the water 4. This time period will typically equate to a particular depth 46 within the water 4 (e.g. based on expected or calculate rate of descent). Alternatively, the triggering 40 may occur at the particular depth 46 in combination with or irrespective of the timing 44. For example, an alternative or additional approach might involve the direct detection of depth (via one or more sensors or similar). Depth may be detected based on time, as above, or perhaps based on water pressure under the surface, the salinity of the water, the temperature of the water, or even at a predetermined speed-of-sound in the water. All of these may be indicative of depth within the water, for example which may be known in advance from mapping of the area, and/or sensed by the munition 10 via one or more sensors when descending through the water.

Of course, the fuze may be also be adapted to trigger the explosive charge upon impact with the target 42. However, it may be safer to employ some form of depth-activation, so that the munition explodes at/near the depth of the target, avoiding possible unintentional explosions at or near objects that are not targets.

As above, the fuze may be programmed with such criteria, or related criteria necessary for the fuze to trigger the explosive as and when intended.

FIG. 5 shows a different adaptation for triggering 40 an explosive charge of the munition 10 under the water, this time upon magnetic detection 50 of a target magnetic signature 52. In a crude sense, the target magnetic signature could simply be the detection of anything magnetic, indicating the presence of a magnetic or magnetisable structure. For instance, once a detected magnetic a field strength is above a relevant threshold, the munition 10 might explode. In a more sophisticated manner, it may be known or derivable in advance to determine what the expected magnetic signature 52 of the particular target 42 might be, might look like, or might approximate to. This might equate to field strength, or field lines, or changes therein. In this example, the munition 10 might not be triggered 40 to explode until the magnetic detection 50 detects a very particular magnetic signature 52, and not simply any magnetic field or change therein.

While FIG. 5 discusses the use of magnetic fields, much the same principle may be used to detect electric field signatures. FIG. 6 shows another example of triggering. In this example, the triggering 40 of the explosive charge in the munition 10 is undertaken based on the detection of pressure waves in the water 4, thereby implementing a sonar-like system 60. The system may be implemented in one of a number of different ways. In one example, the munition 10 may be arranged to detect a pressure wave 62 emanating from target object 42. This could be a sonar pulse 62 originating from the object 42, or simply detection of sound generated by the object 42, or could instead be a reflection 62 of a sonar pulse 64 originating from the munition 10. That is, the projectile 10 may not only detect pressure waves, but may emit pressure waves. As with the magnetic field examples given above, the explosive charge may be triggered 40 when a target sonar signature is detected 60, and this could be when any pressure wave is detected, or more likely when a pressure wave above a certain threshold is detected, or when a particular pressure wave or a series of pressure waves is detected which is indicative of the presence of a particular target 42.

In general, the munition may be able to detect or infer entry into the water, or making contact with the water. This might be useful in initiating or priming fuze activity, for example starting a timer, taking a base or initial reading of pressure, salinity, temperature, and so on (or any relevant criteria), or anything which may assist in the subsequent use of the fuze to trigger the explosive. This sensing or inference could be via an environmental sensor or similar that is (already) present in order to perform another function, for example those discussed or alluded to above. Alternatively, the sensing or inference could be via a dedicated sensor, for example a dedicated impact or water/moisture sensor, or temperate sensor, pressure sensor, salinity sensor, and so on. In general terms, the munition may be able to detect or infer entry into the water, or making contact with the water, for safety reasons, where some (e.g. explosive) function is prevented prior to water contact/entry.

Figure 7:
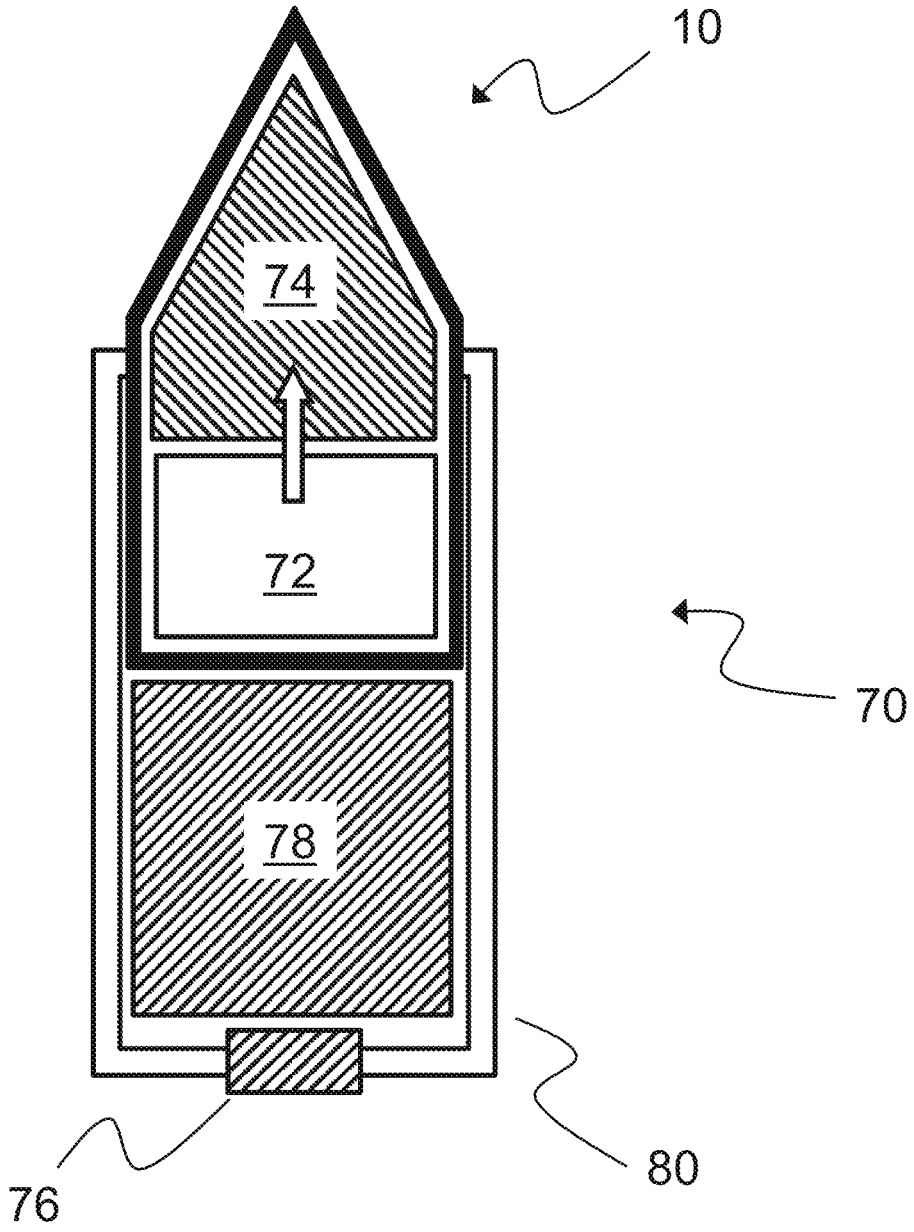

As discussed above, a main principle discussed herein is that the munition is adapted to be launched, into the air, from a gun barrel. This gives good range, and good targeting accuracy, good engagement speed, all at relatively low cost. To this extent, the munition may be described as, or form part of, an artillery shell. FIG. 7 shows such an artillery shell 70. The artillery shell 70 comprises a munition 10 according to any embodiment described herein. The munition 10 will typically comprise a fuze 72 (likely a programmable fuze, as discussed above), which is adapted to trigger an explosive charge 74 also located within a munition. The artillery shell 70 will also comprise a primer 76 and an explosive propellant 78 which may be cased (as shown) or bagged. A casing 80 might also be provided, to hold the munition 10, explosive 78, and primer 76.

In another example, and typical in munitions, the fuze could be located in the nose of the munition (e.g. as opposed to behind the nose as shown in FIG. 7).

It is envisaged that a practical implementation of concepts of the present disclosure would take the form of the artillery shell of FIG. 7, or something similar to that depiction, as opposed to a munition in isolation. In any event, as discussed above, the munition according to the present disclosure is capable of withstanding explosive propulsion-based launch from a gun barrel, in contrast with for instance a depth charge or torpedo. The munition and/or artillery shell (which could be the same thing) will typically have a diameter of 200 mm or less, in contrast with depth charges. The gun barrel-munition/artillery shell assembly typically will be such that the munition has a range of well over 100 metres, typically over 1000 metres, and quite possibly in excess of 20 to 30 kilometres. Again, this is in contrast with a depth charge and a mortar bomb. Balanced with the ranging and target accuracy that launching from a gun barrel gives, the munition will be projectile-like, that is not including any self-propulsion, in contrast with a torpedo or similar. To summarise, then, the approach described above allows for relatively cheap, accurate, rapid, effective and efficient engagement of underwater targets at a significant range. One or more assemblies can be used to launch one or more munitions with such range and effectiveness, in contrast with the launching of depth charges, helicopters including such depth charges, or multiple torpedoes.

Figure 8:
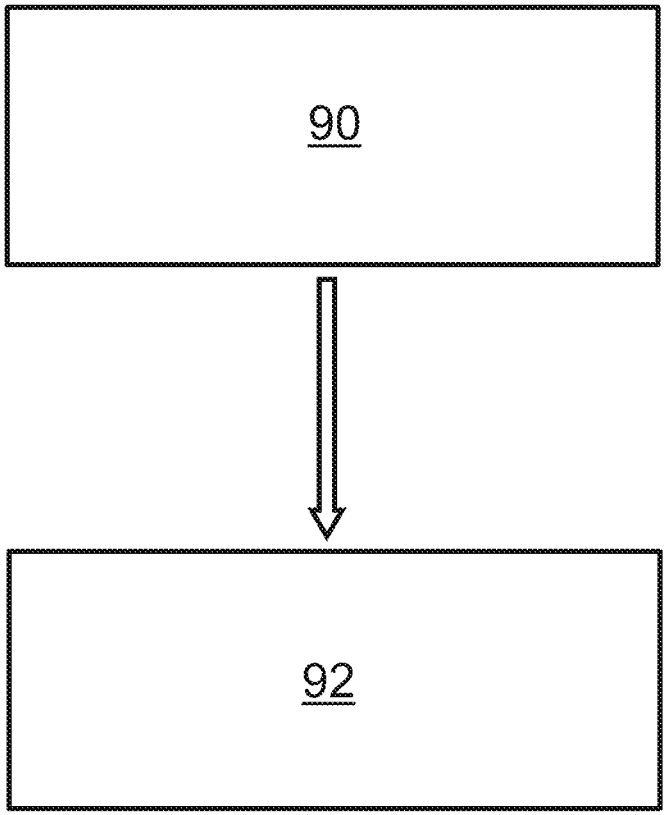

FIG. 8 schematically depicts general principles associated with the method of launching a munition according to an example embodiment. As discussed above, the munition comprises an explosive charge, and a fuze. The munition is adapted to be launched, into the air, from a gun barrel, and enter a body of water. The fuze is adapted to trigger the explosives charge under the water. Accordingly, the method comprises launching the munition into the air, from a gun barrel 90. The launch is configured such that the munition is launched into the body of water 92, such that, as discussed above, the fuze may then be adapted to trigger the explosive charge under the water 92.

In the embodiments discussed above, a munition has been described and detailed. The munition includes an explosive charge. However, in accordance with alternative embodiments, many of the principles discussed above can still be taken advantage of, but without using a projectile including an explosive charge. That is, the above principles can be used to ensure that a projectile can be launched from a gun barrel and into a body of water, when the projectile is then arranged to interact or engage with an object in the water, but without necessarily including an explosive charge to disable or damage that object. In particular, the present disclosure additionally provides a reconnaissance projectile. The reconnaissance projectile is adapted to be launched, into the air, from a gun barrel, and then into contact with a body of water (onto the water surface, or to descend below the surface). Again then, the projectile may be launched at a high range, with a high degree of accuracy, relatively cheaply and quickly. The reconnaissance projectile is arranged to initiate a reconnaissance function when in contact with the body of water (which includes when impacting the water, when on the body of water, or, as above, typically when located under the surface of the water). The reconnaissance function could be anything of particular use in relation to the particular application, but would typically comprise emission and/or detection of a pressure wave in the body of water, in a manner similar to that discussed above in relation to FIG. 6.

Figure 9:
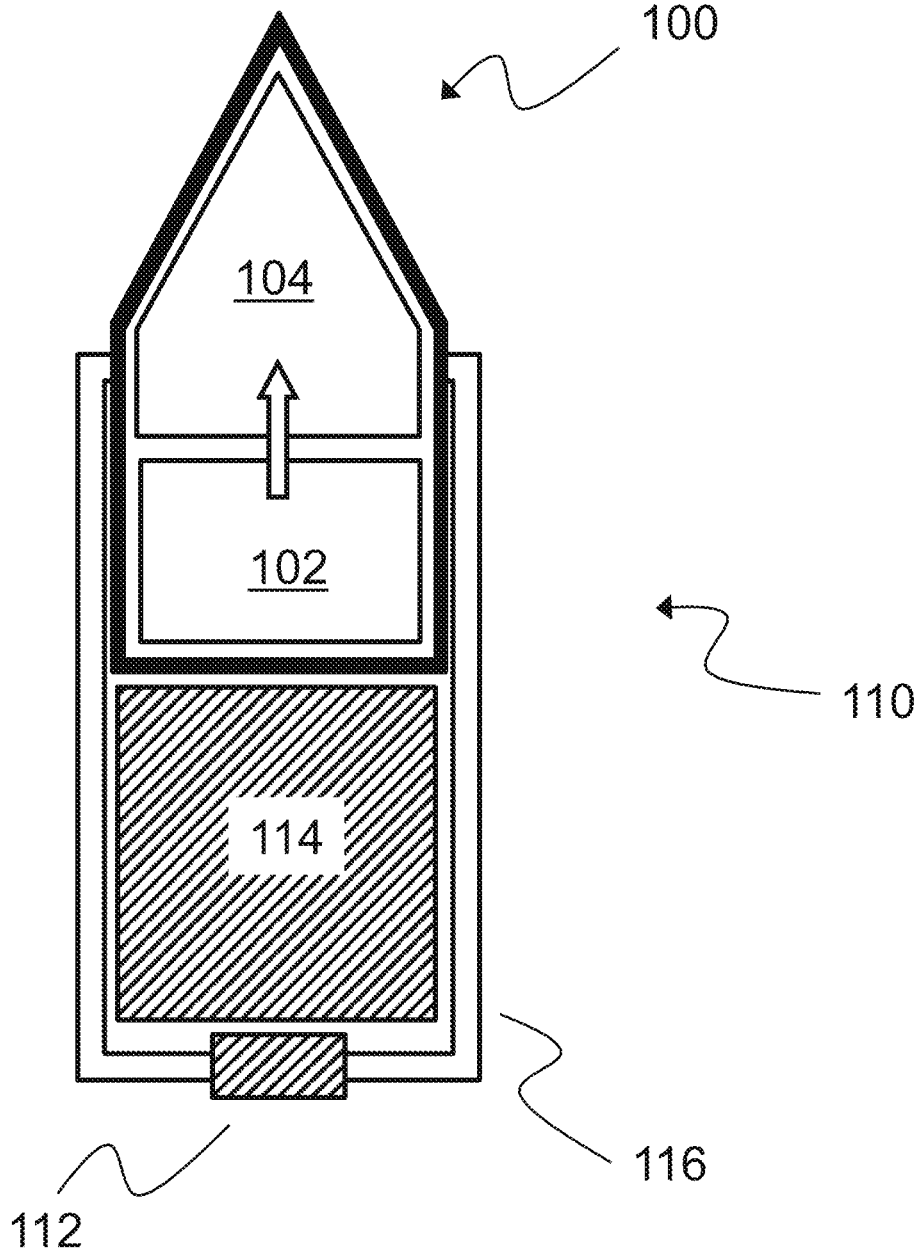

FIG. 9 shows a reconnaissance projectile 100 in accordance with an example embodiment. The reconnaissance projectile 100 comprises a sensor 102. The sensor may be used to detect when the projectile 100 has come into contact with a body of water, and/or provide some other sensing functionality, for example one or more of the sensing or initiation criteria described above in relation to the munition. For example, the sensor 102 may be arranged to detect a particular passage of time, or a particular pressure change, or particular depth, and so on. The reconnaissance projectile 100 also comprises a transceiver 104, in this example. The transceiver may be arranged to emit and/or detect pressure waves in the body of water. The sensor 102 may initiate or process transmission or detection of the waves by transceiver 104. The sensor 102 might, instead or additionally, be or comprise a processor for processing implementing one or more of these functions.

Of course, it will be appreciated that the reconnaissance projectile may take one of a number of different forms, similar or different to that shown in FIG. 9. FIG. 9 is shown simply as a way of schematically depicting what such a projectile 100 might look like.

Much as with the munition described above, the reconnaissance projectile 100 might be used or fired or launched in isolation in some way. However, it is likely that the projectile, being explosively propelled, might take the form of, or form part of, an artillery shell 110. The artillery shell 110 might comprise much the same primer 112, explosive 114 and casing 116 as is already described above in relation to the arrangement of FIG. 7. Referring back to FIG. 9, a difference here is that the artillery shell 110 comprises a non-explosive projectile 100, as opposed to an explosive-carrying munition.

As might now be understood, it will be appreciated that some embodiments described above might be a combination of both explosive-concept, and reconnaissance-concept. For instance, it will be appreciated that the embodiments of FIGS. 5 and 6, at least, already have a degree of in-built reconnaissance, assisting in the initiation of the explosives charge.

It will be appreciated that the above explosive-recon examples could be used in isolation or combination. For instance, a reconnaissance projectile may be launched into a body of water in order to perform a reconnaissance function in relation to a target. That reconnaissance projectile may be provided with a transmitter for transmitting reconnaissance information back to the assembly from which the projectile was launched. This reconnaissance information or data may then be used in the programming of subsequently fired or launched explosive munitions according to example embodiments. Indeed, a volley of projectiles may be launched toward an underwater target in accordance with an example embodiment. One or more of those projectiles may be a munition as described herein, and one or more of those projectiles may be a reconnaissance projectile as described herein. The munitions projectile and the reconnaissance projectile may be arranged to communicate with one another. This means that, for instance, a first-fired reconnaissance projectile may enter the body of water and detect or otherwise the presence of a target, whereas a subsequently fired munitions projectile, which may be in the air or in the body of water at the same time as a reconnaissance projectile, may receive reconnaissance information from a reconnaissance projectile and use this in the initiation (or otherwise) of the explosive charge of the munitions projectile. This may mean that the munitions projectile does not need to carry sophisticated (or as sophisticated) transmission or sensing equipment, which could reduce overall cost or system complexity. Alternatively, the reconnaissance projectile described above could actually be a munitions projectile, for example one of those shown in relation to FIGS. 5 and 6. One or more munitions projectiles may be arranged to perform a reconnaissance functionality, but not necessarily initiate the explosive charge. Any acquired information on the target may be used to initiate the explosives charge of subsequently launched munitions projectiles. Or, or more reconnaissance projectiles may be arranged to perform an explosive function, but not necessarily use the reconnaissance function.

Figure 10:
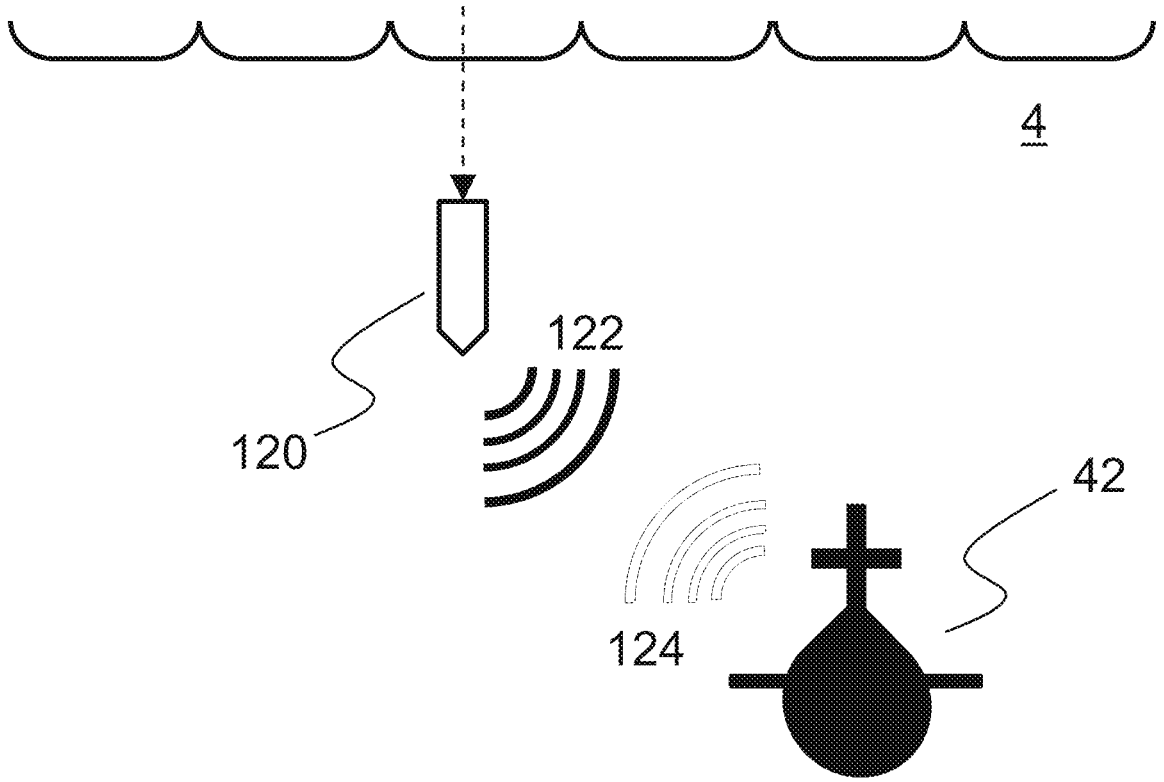

FIG. 10 shows a projectile 120 with reconnaissance functionality 122, 124 entering the body of water 4 in the vicinity of the target 42. Reconnaissance functionality 122, 124 might include emission 122 and/or detection 124 of pressure waves. As discussed previously, the reconnaissance functionality 122, 124 may be completely independent of any explosives charge that the munition 120 is, or is not, provided with. That is, the projectile 120 might have explosive capability, reconnaissance functionality, or a combination of both. Different projectiles 120 launched into the water may have different combinations of such explosive/reconnaissance functionality.

Details of the explosive, fuze and general structure of the munition will vary depending on the required application. For example, the explosive charge could be cartridged or bagged charge. The casing could be reactive. Any explosive might be dependent on how the system is to be used, for example getting the munition near the target, or simply close enough. In the former, an explosive yielding a high bubble effect might be useful. In the latter, simply the level of blast might be more important.

As alluded to earlier in the disclosure, the disclosure also relates to very closely related concepts, but in submunition or sub-projectile form, as in a munition or projectile carried by and then expelled from another (carrier) projectile. This is because further advantages can be achieved, by applying all of the above principles, but in an assembly where the munition or reconnaissance projectile is more particularly a submunition of a munition assembly, or a reconnaissance sub-projectile of a reconnaissance projectile assembly. The submunition or reconnaissance sub-projectile is the object for which controlled entry into, and functionality in, the water is achieved, whereas a carrier of the assembly is simply a tool to get the submunition or reconnaissance sub-projectile to, or proximate to, a target location.

One of the main advantages is that the assembly as a whole, and particularly an outer carrier for carrying the submunition or sub-projectile, can be well or better configured for launch from a gun, with the range and accuracy that such configurations brings. For example, the assembly or the carrier can be bullet-shaped, ogive-shaped or roundly-shaped or tapering, in accordance with the typical shape of munitions. However, and at the same time, the submunition or sub-projectile can then have any desired shape, since the submunition or reconnaissance sub-projectile does not need to be configured for being fired from a gun. This means that the submunition or reconnaissance sub-projectile can then be more easily and readily configured for controlled descent toward and into the water, reducing or preventing damage that might otherwise occur if the munition was fired directly into the water.

Whereas expulsion of the submunition or reconnaissance sub-projectile from its carrier could be achieved underwater, greater benefits are achieved by expulsion in the air, since delicate submunition or reconnaissance sub-projectile components are then not subjected to the force of entry into the water from a natural ballistic, gun-launched, trajectory. Also, the submunition or reconnaissance sub-projectile will be traveling more slowly than a 'conventional' munition, and therefore the water entry shock loading should be reduced, accordingly.

Figure 11:
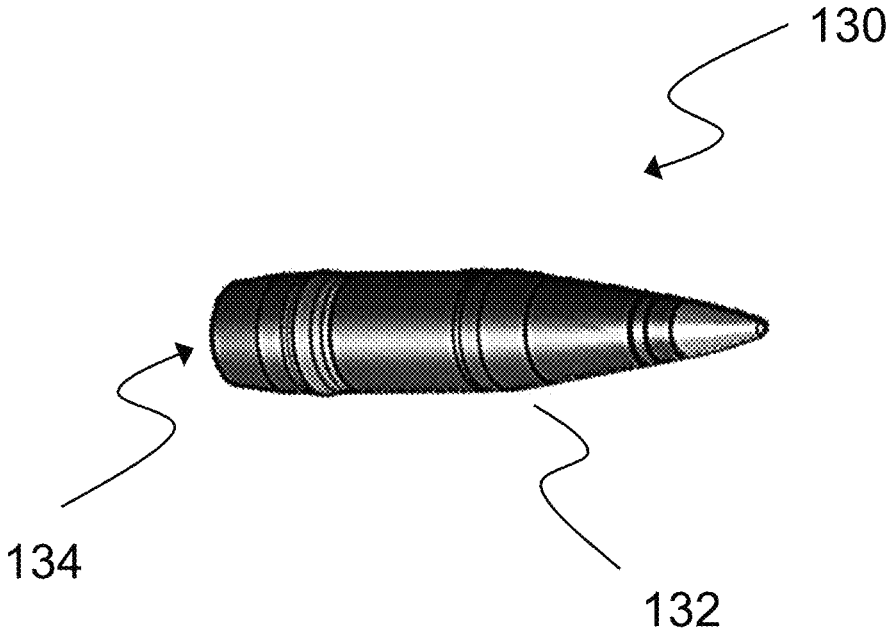
FIG. 11 shows a munition assembly, comprising a carrier and a submunition, in accordance with an example embodiment.

FIG. 11 shows a munition assembly 130, arranged to be launched from a gun, much as with the munition of previous examples. The assembly 130 comprises a carrier 132 for a submunition 134. A nose of the carrier 132 is ogive-shaped or roundly-shaped or tapering, for greater aerodynamic performance. The carrier 132 comprises (which includes defines) a cavity in which the submunition 134 is located. The cavity retains and protects the submunition 134, and so shields the submunition 134 during launch and flight conditions of the assembly 130.

The assembly 130 may be launched and generally handled much as with the munition of earlier examples. However, in previous examples, controlled descent of the entire launched projectile, in the form of the (single-bodied) munition, is implemented. In the present examples, the submunition is expelled from its carrier, and controlled descent of the submunition is implemented, in the same manner as with the munition of previous examples. Again, then, the advantage of the present examples is that munition assembly can be tailored for launch and flight conditions, and the submunition can be tailored for descent and target engagement. The two-body approach allows for tailoring of a two-part problem.

Figure 12:
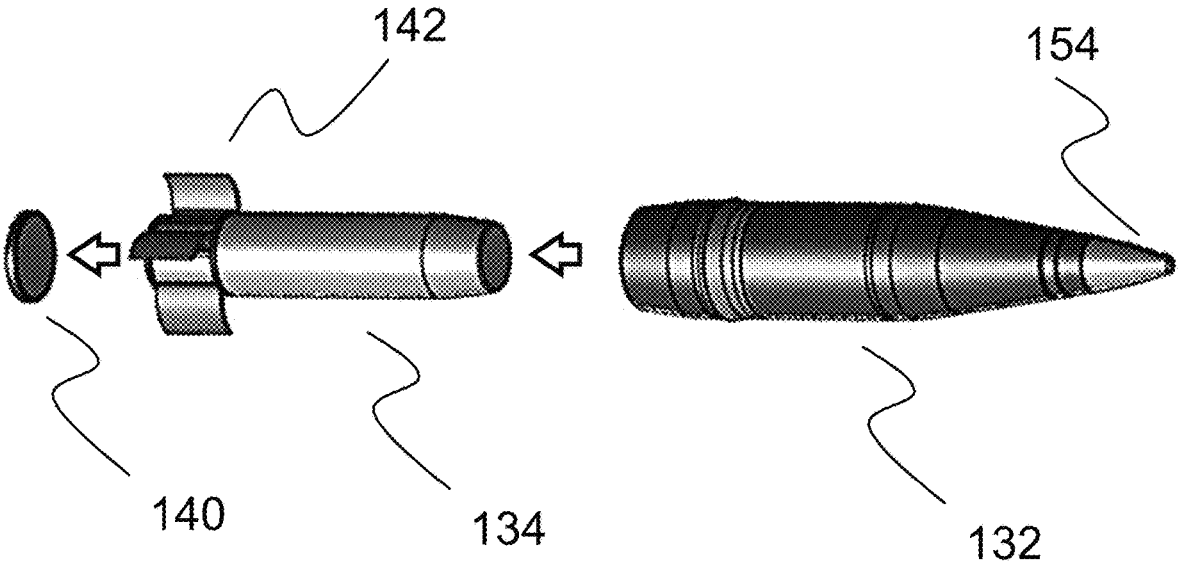
FIG. 12 shows an exploded view, and/or functionality, of the munition assembly of FIG. 11, in accordance with an example embodiment.

FIG. 12 shows that the submunition 134, initially carried by the carrier 132 in the cavity, is arranged to be controllably expelled from the carrier. This might be achieved by use of a fuze and an expulsion charge, for example a carrier fuze 154 and a carrier expulsion charge. The carrier fuze 154 may operate on a timer, triggering the carrier expulsion charge to expel the submunition at or proximate to a target location, for example above a location of a target. As with the fuze of the (sub)munition, the carrier fuze may be programmed with a particular timing, or any other set of conditions, for example location-based activation, environmental sensing-based activation, and so on.

The submunition 134 is expelled via a rear end of the carrier 132. This is advantageous, as this might better ensure the maintenance of a predictable ballistic trajectory of the submunition 134 or carrier 132, or prevent the carrier 132 from impacting upon the submunition 134. As above, it is the submunition 134 for which slow, controlled descent is desirable, and so leaving the carrier 132 via a rear end allows for much more design and functional control, in implementing this.

The submunition may be arranged to be expelled from a rear end of the carrier via a closure 140. The closure might generally close or seal off the submunition 134 within the carrier 132. This might be useful for handling or safety reasons, or assist in shielding the submunition from launch and flight conditions. The closure 140 is arranged to be opened before or during expulsion of the submunition 134. This could be an active opening, for example via a controlled electronic or pneumatic switch or opening mechanism. However, it is likely to be simpler for this opening to be relatively passive or responsive, in that the closure 140 is arranged to open, for example via a shearing action, due to pressure of the expulsion charge on the opening, either directly, or indirectly via contact with the submunition 134 itself.

As with the munition of previous examples, the submunition 134 comprises a deployable configuration 142 that is arranged, when deployed, to slow the submunition 142 in the air, after expulsion from the carrier 132, and before entry to the water. The deployment could be active, for example based on sensing of air flow or submunition release, and an electrical or mechanical system actively deploying the configuration 142. However, a more passive, automatic deployment may be simpler to implement, and more reliable. For example, FIG. 12 shows that wings or fins 142 might automatically deploy, to provide a degree of auto rotation to slow or further slow the munition 134 during its descent. The wings or fins 142 could be spring loaded, in a compressed or closed state, when in carrier 132, and then automatically uncompress or open when expulsion is implemented. Alternatively, the act of air flow during or after expulsion may force the wings or fins 142 to deploy.

Figure 13:
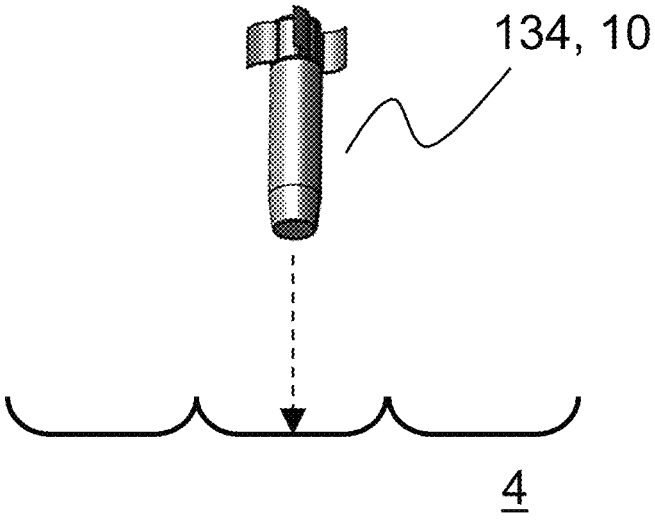
FIG. 13 shows a submunition of the munition assembly of FIG. 11, being directed towards a body of water, in accordance with an example embodiment.

FIG. 13 shows that the submunition 134 functions largely as the munition 10 of previous examples, descending toward and eventually onto or into the body of water 4, for engagement with a target. A submunition fuze is then adapted to trigger a submunition explosive charge, under water.

Figure 14:
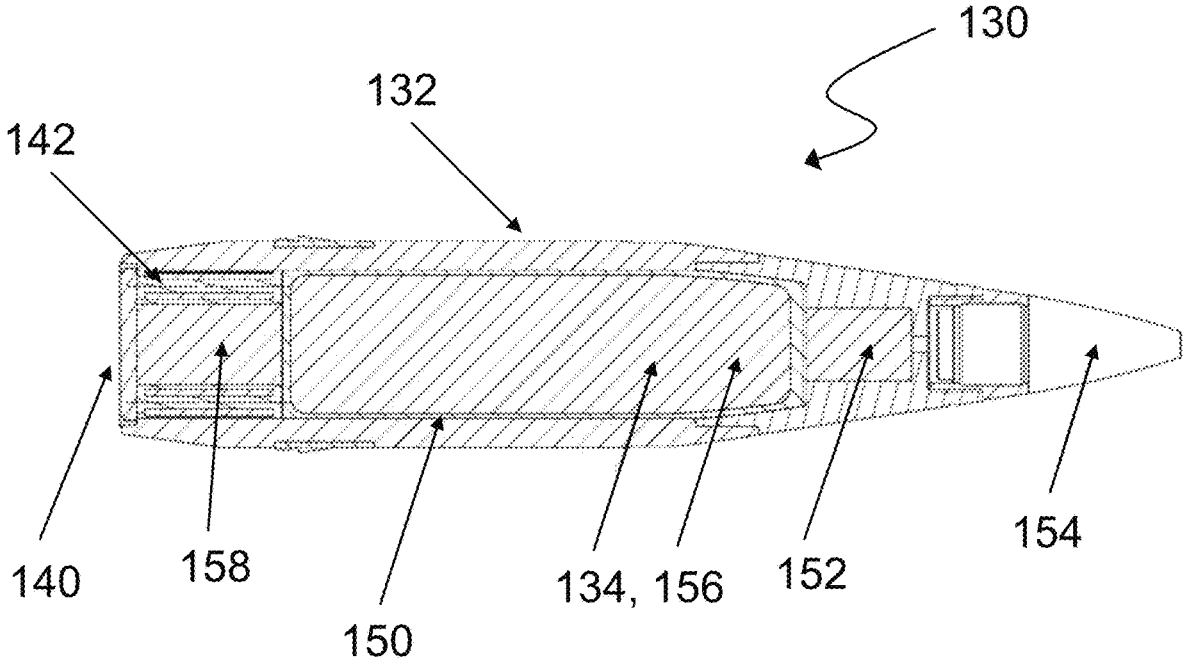
FIG. 14 shows a more detailed, cross-section, view of the munition assembly of FIG. 11, in accordance with an example embodiment.

FIG. 14 shows a more detailed view of the munition assembly 130. The munition assembly 130 is arranged to be launched from a gun. The assembly 130 comprises: a carrier 132 for a submunition 134. The carrier comprises a cavity 150 in which the submunition 134 is located. The carrier 132 may be, or may form, a (carrier) shell.

The submunition 134, carried by the carrier 132 in the cavity 150, is arranged to be controllably expelled from the carrier 134. The carrier 132 comprises a carrier expulsion charge 152 and a carrier fuze 154, the charge 152 being located in-between the submunition 134 and the fuze 154. The fuze is typically located in a nose of the assembly 130 or carrier 132. The carrier fuze 154 is adapted to trigger the carrier expulsion charge 152 to controllably expel the submunition 134 from the carrier 132, via the closure 140 at the rear of the carrier 132

The submunition 134 comprises wings or fins 142, arranged to auto-deploy upon expulsion, so as to slow down the descent of the submunition toward and into the water. Such a deployable configuration is typically located at a rear (in terms of eventual descent direction) end of the submunition, to maintain descent stability.

The submunition comprises a submunition (main) explosive charge 156, and a submunition fuze 158. The submunition fuze 158 is typically located at a rear (in terms of eventual descent direction) end of the submunition 134, to reduce the risk of damage to any sensitive components, during impact with the water. The munition assembly 130 is adapted to be launched, into the air, from a gun barrel, where the submunition 134 is then arranged to be controllably expelled from the carrier 132 and enter a body of water, and the submunition fuze 158 is adapted to trigger the submunition explosive charge 156 underwater.

Again, descent of the submunition, and activation of its fuze, may be implemented as described above in relation to the munition embodiments.

All of the principles described in relation to the submunition apply equally to a reconnaissance sub-projectile carried by a carrier of a reconnaissance projectile assembly. That is, the reconnaissance sub-projectile has the benefits of being carried and deployed like the submunition as described above, but also with the reconnaissance functionality, as described above.

Any of the projectiles described herein, including munitions, submunitions, or reconnaissance projectiles or sub-projectiles, may be arranged to communication with, or transmit to, other objects. For example, munitions, submunitions, or reconnaissance projectiles or sub-projectiles, may be arranged to transmit a communication signal, external to and away from the submunition after entering the water, and optionally after a predetermined time period after entering the water; upon detection of a target sonar signature; upon detection of a target magnetic signature; upon detection of a target electric field signature; at a predetermined pressure under the water surface; at a predetermined depth under the water surface; at a predetermined salinity of water; at a predetermined temperature of water; at a predetermined speed-of-sound in water; or upon impact with a target under the water surface. The communication with, or transmission to, could be in relation to a remote weapon or platform, which could engage with the target depending on the communication or transmission. For instance, a submunition or reconnaissance sub-projectile may provide a warning shot, or a detection function, in advance of a more escalated engagement from the remote weapon or platform (e.g. a submarine, or torpedoes from a submarine).

In the above examples, a fuze has been discussed and described quite generally. The fuze has been described as triggering an explosive charge of the munition, or more specifically a munition in the form of a submunition. As discussed above, great care needs to be taken to ensure that the fuze is triggered as and when intended, for example at a target location, and not at an unintended location, for example during maintenance or launch of the submunition or related munition assembly. For instance, in a possible fuze system that incorporates a fuze for triggering an explosive charge, a first stage of the system may be used for detecting launch of a munition assembly comprising a carrier and a carried submunition. A second stage may be used for detecting expulsion of the submunition from its carrier. The concept is that the two different stages provide two different checks, to ensure that the fuze triggers the explosive charge only when intended. However, in these approaches, the two stages are independent of one another. This is risky. This is because an environmental condition that might activate or trigger the stage that detects launch of the munition assembly might inadvertently and unintentionally trigger or activate the second stage, which is actually intended to detect expulsion of the submunition from its carrier. Due to this independence, then, this means that a fuze can be armed, or a fuze can trigger an explosive charge, due to different environmental conditions, inadvertently and unintentionally causing the overall fuze system to function in a way that was not intended.

The above problems are common to any munition assembly that comprises a carrier and a carried submunition, due to the need to in some way launch that assembly, and then subsequently expel the submunition from its carrier, for example for engaging a target with the submunition. However, these problems are particularly prevalent and highlighted in conjunction with the embodiments described above, where a munition assembly is launched from a gun, and the munition or submunition is eventually triggered to explode under the water. This exposes the munition assembly and its associated submunition and fuze system to massively different environmental conditions, including those related to forces, speeds, accelerations, impacts, and so on.

According to the present invention, it has been realised that significant advantages can be realised by, in fact, removing a degree of independence of the two stages of the fuze system described above. That is, according to the present invention, it has been realised that there are numerous advantages in implementing a system or method where the second stage is unable to at least partially arm the submunition fuze, without the first stage detecting launch of the submunition and its associated carrier. This means that any associated explosive charge of a submunition cannot be triggered unless launch of that submunition and its carrier is detected, and also expulsion of the submunition from its carrier is detected. Perhaps more importantly and subtly, the second stage is unable to function without the first stage detecting the launch of the submunition, which means that the submunition may be safely removed from its carrier, for example for maintenance or inspection purposes, without the fuze of the system being in a fully armed state. This is because a launch condition of or for the submunition and its carrier has not been detected.

There are further related, yet potentially independent, advantages with the second stage electronically (as opposed to mechanically) detecting separation of the submunition from its associated carrier. Electronic detection may, in general, be safer than a mechanical alternative. The mechanical alternative might require more maintenance and inspection to ensure its safe operation, or might be more likely to fail in significant or extreme environmental conditions, such as launch of the related munition assembly from a gun, or entry or the submunition into a water environment. Also, electronic detection might find synergy with the concept described above, in the second stage being unable to at least partially arm the fuse without the first stage detecting launch of the submunition as associated carrier. This is because this readily allows the first stage to control the supply of electrical power to the second stage to implement that particular concept. Again, this might be simpler and more effective or reliable than, for example, mechanical control.

It is perhaps worth noting at this stage that there is a subtle but important difference between separation of the submunition from its carrier, and expulsion of the submunition from its carrier. Separation of the submunition from the carrier is perhaps a more general, or broader term, and is intended to encompass and cover removal of the submunition from a carrier for maintenance or inspection purposes. However, this same term is also intended to cover and encompass explosive expulsion of the submunition from the carrier, for example using the expulsion charge described above. Separation might include a separation event, wherein the submunition is at least partially, and typically wholly, separated from the carrier, such that at least a part of the submunition has left the carrier and typically the entire submunition has left the carrier. At the same time, but in contrast, expulsion means that the carrier has not just been at least partially separated from the carrier but has been done so in a particular manner, in that it has been expelled by way of an expulsion or explosive charge or similar. These differences may be important in safe arming of a fuse, or triggering of an associated explosive charge, and will be discussed in more detail below.

FIG. 15 schematically depicts the simplified view of a portion of the submunition 134 and carrier 132 already shown in and described with reference to FIG. 14. Fuze 158 is now shown as being part of an overall fuze system 200.

The fuze system 200 comprises a first stage 202, arranged to detect launch of the submunition 134 and its associated carrier 132, for example from a gun or gun barrel as described in the examples above.

The first stage 202 might be arranged to detect launch of the submunition 134 and its associated carrier 132 based on detecting an indicative environmental property of such launch. For instance, the environmental property or condition might be a property indicative of a speed or acceleration of submunition 134 and its carrier 132, and/or a property indicative of a spin rate of the submunition 134 and its associated carrier 132. These properties or related conditions can have associated thresholds which would be clearly indicative of for example, an explosive propulsion linked to launch of the submunition 134 and its carrier 132. For example, simply moving, dropping, or dismantling submunition 134 and its carrier 132 may not result in launch-indicating speed, acceleration or spin thresholds being met or exceeded.

For additional safety or redundancy, detection of certain environmental conditions might not be sufficient to safely or confidently detect launch of the submunition 134 and its carrier 132. Instead, it may well be preferable for two of such conditions to be detected in combination (that is not simply one of those conditions), for example a certain speed or acceleration, and a certain spin-rate. For even greater safety or redundancy, detecting of one or two or more environmental conditions, in isolation or combination, might be supplemented with detecting an order of such detection. For instance, if the submunition 134 and its carrier 132 have been successfully launched, it is already known in advance that explosive propulsion should be detected before the submunition 134 and its carrier 132 begin to spin, or spin at a particular rate, or spin for a particular time.

The fuze system 200 comprises a second stage 204, arranged to detect expulsion of the submunition 134 from the carrier 132, and to at least partially arm the submunition fuze 158 based on such detection.

The second stage might be arranged to detect separation of the submunition 134 from the carrier 132 and/or expulsion of the submunition 134 from the carrier 132. This might give some additional control or redundancy in terms of safely arming the fuze 158. For instance, the fuze 158 may be more safely and reliably at least partially armed by the second stage 204 if detection of separation and expulsion is detected, and even more so if expulsion is detected prior to separation. The separation and expulsion may be detected in different ways, so that separate, independent detection is achievable, again for safety reasons.

Detection of separation will typically be based on detecting a property indicative of the presence or absence of the carrier 132. For instance, this might be undertaken via mechanical or electrical sensors or systems. Detection of expulsion of the submunition 134 from the carrier may be based on detecting a property indicative of a speed or acceleration of the submunition 134, for example a threshold speed or acceleration being indicative of expulsion, and a speed or acceleration beneath that threshold being indicative of no expulsion taking place. For instance, beneath this threshold, the submunition 134 may simply be being removed from the carrier 132 for inspection or maintenance purposes or similar.

As alluded to above, there may be advantages in ensuring that the (second) stage that is arranged to detect separation and/or expulsion from its associated carrier is arranged to do so in an electronic manner. In a related manner, therefore, the first stage 202 may be arranged to control the supply of electrical power to the second stage 204, conditional on detecting launch of the submunition 134 and its associated carrier 132. For example, this may be achieved by the first stage actually supplying power to the second stage 204, or the first stage 202 in some way controlling a separate power supply that is arranged to supply power to the second stage 204.

If the first stage 202 provides the electrical power to the second stage 204, supply of power may be triggered or generated by the actual launch of a submunition 134 and its associated carrier 132. For example, a mechanical or electrical state may be triggered, or change, as a result of the launch. Again all of this provides additional safety benefits, in terms of the second stage 204 being unable to function at all, or being unable to detect separation or expulsion of a submunition 134, or being unable to at least partially arm the fuze 158, without the supply of electrical power. This is far easier, convenient, safer and reliable to implement than via a mechanical implementation. For example, the second stage 204 and/or the related fuze 158 may be based on electronic firing in line (EFI) principles, such that no power provided to the second stage 204 or fuze 158 means that no arming is possible. Of course, other electrical implementations are possible.

FIG. 15 shows that the second stage 204 comprises sensing functionality, in this case in the form of a sensor 206. The sensing functionality or sensor 206 may be implemented in such a way that sensing is not possible, or output from the sensing is not possible, without the second stage 204 being provided with electrical power, or at the very least without the first stage 202 detecting launch of the submunition 134 and carrier 132.

In one example, the sensor 206 may be a Hall effect sensor, or an optical reflection sensor (e.g. using IR, visible or UV electromagnetic radiation), or an electroacoustic transducer, an acoustic transmitter and receiver, or electromagnetic conduction based sensors. Any sensor may be used which is capable of detecting the presence or absence of the carrier 132, and typically in a non-contact manner 208. Of course, physical contact will be required in a mechanical sensing environment, but such physical contact is potentially less reliable and requires more maintenance. This is significant, in the extreme and harsh environmental conditions in which the invention is to be implemented.

Again as alluded to above, the electronic nature of the detection performed by the second stage 204 may be advantageous in isolation, for example not in relation to or in dependence of the first stage 202 detecting launch of the submunition 134 and carrier 132. This is because the electronic second stage 204 may be advantageous in generally making the handling of the submunition 134 and carrier 132 safer. For instance, because the electronic detection does not rely on mechanical means, the submunition 134 may for example be more safely removed from the carrier 132 for inspection or maintenance with a lower risk of inadvertently arming the fuze. For example, it may be easier to separate launch, expulsion, and separation events, using electronic detection. Mechanical events that might trigger launch or expulsion detection cannot inadvertently trigger a false detection of separation. In general, electronic sensing and processing is likely to be far more easier and safer to implement than a mechanical-based system.

FIG. 15 shows that an additional stage 210 may be provided for use in fully arming the fuze 158. For instance this additional stage 210 may detect environmental conditions associated with a target environment, for example as discussed at above in relation to depth or proximity of a target location and so on. Only if the fuze 158 is armed by the second stage 204 (in dependence of the appropriate detection by the first stage 202), and the additional stage 210 detects intended target environmental conditions, is the fuze 158 fully armed and therefore able to trigger the explosive charge 156.

FIG. 16 schematically depicts general methodology associated with an aspect of the operation of the system of FIG. 15. FIG. 16 depicts a fuze arming method for a submunition. The method comprises detecting launch of the submunition and its associated carrier 220. The method additionally comprises detecting expulsion of the submunition from the carrier 222. The method finally comprises at least partially arming a submunition fuze based on the detection of expulsion 224. Significantly, the submunition fuze is unable to be at least partially armed, without detecting launch of a submunition and its associated carrier. This approach also means that the submunition is in a state for being triggered to explode, having been launched, and having explosively left its carrier.

FIG. 17 schematically depicts general methodology associated with a different but related aspect of the operation of the fuze system of FIG. 15. The method related to a fuze arming method for a submunition. The method comprises electronically detecting separation of the submunition from its associated carrier 230. The method additionally comprises at least partially arming a submunition fuze based on such detection 232. This does not necessarily mean that the fuze can trigger an explosive charge. Other conditions may need to be met. Important is that the separation is detected, and done so electronically.

Although a few preferred embodiments have been shown and described, it will be appreciated by those skilled in the art that various changes and modifications might be made without departing from the scope of the invention, as defined in the appended claims.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A fuze arming system for a submunition, the system comprising:

a first stage, arranged to detect launch of the submunition and a carrier associated with the submunition; and a second stage, arranged to detect expulsion of the submunition from the carrier and to detect separation of the submunition from the carrier, and to at least partially arm a submunition fuze based on the detection of expulsion of the submunition from the carrier;

wherein the second stage is unable to at least partially arm the submunition fuze without the first stage detecting launch of the submunition and the carrier; and wherein the second stage is arranged to at least partially arm the submunition fuze based on detecting the expulsion prior to detecting the separation.

2. The fuze arming system of claim 1, wherein the first stage is arranged to control the supply of electrical power to the second stage, conditional on detecting launch of the submunition and the carrier.

3. The fuze arming system of claim 2, wherein the first stage is arranged to supply electrical power to the second stage, conditional on detecting launch of the submunition and the carrier.

4. The fuze arming system of claim 3, wherein the supply of electrical power is triggered or generated by launch of the submunition and the carrier.

5. The fuze arming system of claim 1, wherein the second stage is arranged to electronically detect the separation of the submunition from the carrier and the expulsion of the submunition from the carrier.

6. The fuze arming system of claim 5, wherein the second stage is unable to electronically detect the separation and the expulsion without being supplied with electrical power.

7. The fuze arming system of claim 1, wherein detection of both separation and expulsion is required to at least partially arm the submunition fuze.

8. The fuze arming system of claim 1, wherein the first stage is arranged to detect launch of the submunition and the carrier based on detecting a property indicative of a speed or acceleration of the submunition and the carrier, and/or detecting a property indicative of a spin rate of the submunition and the carrier.

9. The fuze arming system of claim 8, wherein the first stage is arranged to detect launch of the submunition and the carrier based on:

detecting a property indicative of a speed or acceleration of the submunition and the carrier, and a property indicative of a spin rate of the submunition and the carrier; and detecting the property indicative of speed or acceleration before the property indicative of the spin rate.

10. A submunition comprising the fuze arming system of claim 1.

11. A munition assembly, comprising:

a carrier comprising a cavity; and the submunition of claim 10, the submunition being located in the cavity of the carrier and arranged to be controllably expelled from the carrier, wherein the submunition includes a submunition explosive charge and a submunition fuze, the submunition fuze being adapted to trigger the submunition explosive charge;

wherein the munition assembly is adapted to be launched.

12. The munition assembly of claim 11, wherein the assembly is adapted to be launched into the air from a gun barrel; and the submunition fuze is adapted to trigger the submunition explosive charge under water.

13. A fuze arming method for a submunition, the submunition including a submunition fuze, the method comprising:

detecting launch of the submunition and a carrier associated with the submunition;

detecting expulsion of the submunition from the carrier;

detecting separation of the submunition from the carrier; and at least partially arming the submunition fuze based on the detection of expulsion of the submunition from the carrier, wherein the submunition fuze is unable to be at least partially armed, without detecting the launch of the submunition and the carrier; and arranging the second stage to at least partially arm the submunition fuze based on detecting the expulsion prior to detecting the separation.

14. The method of claim 13, wherein detecting launch of the submunition and the carrier is based on:

detecting a property indicative of a speed or acceleration of the submunition and the carrier, and a property indicative of a spin rate of the submunition and the carrier; and detecting the property indicative of speed or acceleration before the property indicative of the spin rate.

15. The fuze arming system of claim 5, wherein detection of separation is based on detecting a property indicative of the presence or absence of the carrier, and/or detection of expulsion is based on detecting a property indicative of speed or acceleration of the submunition.

16. The munition assembly of claim 12, wherein the submunition is arranged to, subsequent to the assembly being launched from a gun barrel, be controllably expelled from the carrier and enter a body of water.

17. A fuze arming system for a submunition, the system comprising:

a first stage, arranged to detect launch of the submunition and a carrier associated with the submunition; and a second stage, arranged to detect both (1) expulsion of the submunition from the carrier and (2) separation of the submunition from the carrier, and to at least partially arm a submunition fuze, wherein detection of expulsion before separation is required to at least partially arm the submunition fuze;

wherein the second stage is unable to at least partially arm the submunition fuze without the first stage detecting launch of the submunition and its associated carrier; and wherein the first stage is further arranged to control supply of electrical power to the second stage, conditional on detecting launch of the submunition and the carrier.

18. The fuze arming system of claim 17, wherein the first stage is arranged to detect launch of the submunition and its associated carrier based on:

detecting a property indicative of a speed or acceleration of the submunition and the carrier, and a property indicative of a spin rate of the submunition and the carrier; and detecting the property indicative of speed or acceleration before the property indicative of the spin rate.

19. The fuze arming system of claim 17, wherein the second stage is arranged to electronically detect both the expulsion of the submunition from the carrier and the separation of the submunition from the carrier.

* * * * *